US010428631B2

(12) United States Patent
Noblett et al.

(10) Patent No.: US 10,428,631 B2
(45) Date of Patent: Oct. 1, 2019

(54) SUBTERRANEAN FORMATION METHODS AND APPARATUS

(71) Applicant: Darcy Technologies Limited, Aberdeen (GB)

(72) Inventors: David Allan Noblett, Aberdeen (GB); Stephen Edmund Bruce, Aberdeen (GB); Dominic Patrick Joseph McCann, Aberdeen (GB); Stephen Kent, Aberdeen (GB)

(73) Assignee: HALLIBURTON MANUFACTURING AND SERVICES LIMITED, London (GB)

( * ) Notice: Subject to any disclaimer, the term of this patent is extended or adjusted under 35 U.S.C. 154(b) by 360 days.

(21) Appl. No.: 14/407,475

(22) PCT Filed: Jun. 14, 2013

(86) PCT No.: PCT/GB2013/051558
§ 371 (c)(1),
(2) Date: Dec. 12, 2014

(87) PCT Pub. No.: WO2013/186569
PCT Pub. Date: Dec. 19, 2013

(65) Prior Publication Data

US 2015/0144330 A1 May 28, 2015

(30) Foreign Application Priority Data

Jun. 14, 2012 (GB) ..... 1210532.6

(51) Int. Cl.
*E21B 43/16* (2006.01)
*E21B 33/127* (2006.01)
(Continued)

(52) U.S. Cl.
CPC ..... *E21B 43/16* (2013.01); *E21B 33/129* (2013.01); *E21B 33/1277* (2013.01);
(Continued)

(58) Field of Classification Search
CPC .... E21B 43/103; E21B 49/006; E21B 43/025; E21B 43/08; E21B 43/16; E21B 43/105;
(Continued)

(56) References Cited

U.S. PATENT DOCUMENTS

2009/0055098 A1* 2/2009 Mese ..... E21B 43/00 702/13
2010/0186969 A1* 7/2010 Metcalfe ..... E21B 33/1277 166/382
2013/0032336 A1* 2/2013 Abbate ..... E21B 43/24 166/250.01

FOREIGN PATENT DOCUMENTS

WO 2012/066290 A2 5/2012

OTHER PUBLICATIONS

International Search Report and Written Opinion for International Application No. PCT/GB2013/051558 dated Jul. 11, 2014.

* cited by examiner

*Primary Examiner* — Robert E Fuller
*Assistant Examiner* — Christopher J Sebesta

(57) ABSTRACT

A method is for use with subterranean formations, such as oil and/or gas reservoirs. In some examples (e.g., production examples), the method improves the production from that formation. Some of the examples of the method describe selecting both an exertive force (e.g., a pressure) to apply at a wellbore, but together with a drawdown pressure at the wellbore to modify operations (e.g., improve production) at that subterranean formation. The selection of one or both of the exertive force and drawdown pressure may be based on the downhole environment at that wellbore, which can
(Continued)

include the porosity and/or permeability of a near-wellbore formation radially surrounding a wellbore. The exertive force and drawdown pressure may be specifically selected to modify the porosity and/or permeability of the near-wellbore formation.

28 Claims, 21 Drawing Sheets

(51) Int. Cl.

| | |
|---|---|
| ***E21B 33/129*** | (2006.01) |
| ***E21B 43/02*** | (2006.01) |
| ***E21B 43/08*** | (2006.01) |
| ***E21B 43/10*** | (2006.01) |
| ***E21B 41/00*** | (2006.01) |
| *E21B 49/00* | (2006.01) |

(52) U.S. Cl.
CPC ..... *E21B 41/0092* (2013.01); *E21B 43/025* (2013.01); *E21B 43/08* (2013.01); *E21B 43/105* (2013.01); *E21B 43/108* (2013.01); *E21B 49/006* (2013.01)

(58) Field of Classification Search
CPC .. E21B 43/108; E21B 33/127; E21B 33/1277; E21B 33/129; E21B 41/0092
See application file for complete search history.

STAGE 2 - PRESSURE UP TO INFLATE

STAGE 3 - BLEED PRODUCTION BORE PRESSURE

STAGE 4 - MECHANICALLY SHUT OFF PRODUCTION

SUBTERRANEAN FORMATION METHODS AND APPARATUS

REFERENCE TO RELATED APPLICATION

This application is a United States National Phase application of PCT Application No. PCT/GB2013/051558 filed on Jun. 14, 2013, which claims priority to United Kingdom Application No. 1210532.6 filed on Jun. 14, 2012.

TECHNICAL FIELD

The invention relates to the field of subterranean formation methods and apparatus, such as production methods, injection methods, etc., as well as associated apparatus.

BACKGROUND OF THE INVENTION

When a well is provided into a subterranean formation, such as a reservoir, the step of drilling the wellbore and removal of, for example, oil from the reservoir causes the forces, including stresses, and pressures, in the formation surrounding the wellbore to be modified, or redistributed. The modification, or redistribution, of forces, including stresses, pressures, etc., of the formation surrounding the wellbore may occur when producing from a well, for example when extracting oil and/or gas, as well as when injecting into the well, for example, when injecting water, fracturing fluid, or the like, into the formation.

Such modification or redistribution of these forces can, in some cases, cause the formation to yield. As the formation yields it changes from a state of compression, through dilation and eventually undergoes a level of compaction (i.e., collapse of the formation rock).

During this yielding process, formations fines are released, sand is mobilised and the formation can start to transmit loads to the wellbore, as well as completion equipment located in the wellbore. Furthermore, the porosity and permeability of the formation near the wellbore is affected.

When producing from a well, other substances can be produced which are undesirable. For example, water can be additionally produced when intending to produce oil and gas. This production of water can be commercially unhelpful. In some cases, those other substances may be produced from one particular region of the wellbore.

All of these factors can have an impact on the ability to operate a subterranean formation, such as a reservoir. For example, these factors can also increase the level of effort or costs associated with maintaining the well in production, or at least maintaining the well in production at a commercially beneficial level.

This background serves to set a scene to allow a skilled reader to better appreciate the following description. Therefore, none of the above discussion should necessarily be taken as an acknowledgement that that discussion is part of the state of the art or is common general knowledge. One or more aspects or embodiments of the invention may or may not address one or more of the background issues.

SUMMARY OF THE INVENTION

According to aspects of the invention, there are provided methods and apparatus for use with subterranean formations, such as reservoirs.

In some embodiments, the method may include selecting an exertive force to apply at a wellbore in order to modify operations at a subterranean formation (e.g., reservoir). The method may include selecting a drawdown pressure at the wellbore in order to modify operations the formation. The selection of one or both of the exertive force and drawdown pressure may be based on the downhole environment at that wellbore. In other words, the selection of one or both of the exertive force and drawdown pressure may be determined from the downhole environment at that wellbore.

The exertive force and/or drawdown pressure may be applied at a wellbore in order to modify operations at the formation, for example, modify, assist with, or improve production from the wellbore. The exertive force and/or drawdown pressure may be applied at a wellbore in order to reduce production from a reservoir. For example, the exertive force and/or drawdown pressure may be applied at a wellbore in order to reduce production of water at a region at the wellbore.

The drawdown pressure may be a fluid pressure at the wellbore. The fluid pressure may be the differential pressure (e.g., the differential pressure) between the formation (e.g., reservoir) and the wellbore, such as between the formation and the wellbore at a production zone, which causes fluid to flow between formation and the wellbore. The fluid pressure may be considered to be the differential pressure between the formation static pressure and wellbore flowing pressure.

The drawdown pressure may be considered to be associated with a pressure at which fluids, such as hydrocarbons, are removed from the formation at the wellbore. The drawdown pressure may be associated with a particular drawdown force, per unit area. The drawdown pressure may be considered to be the differential pressure between the static pressure in reservoir, or at least a near-wellbore formation (e.g., when the well is not producing), and the wellbore at a production zone (e.g., at a region where oil, or the like, enters the wellbore, during flow conditions).

The method may additionally include selecting a hydrostatic pressure at the wellbore in order to modify operations at the formation. The hydrostatic pressure may be considered to be the pressure provided by any mud, or the like, in the wellbore. The selection of the hydrostatic pressure may include selecting a particular mud to use (e.g., selecting a particular mud based on the weight of the mud, for example, the weight of the mud and the depth of the wellbore).

The exertive force and/or drawdown pressure may be applied at a wellbore in order to modify operations at the formation, for example, modify or improve injections at the wellbore. The exertive force and/or drawdown pressure may be applied at a wellbore in order to increase the ability to inject into the formation.

In such cases, the drawdown pressure may be considered to be a negative drawdown pressure, which may be called an injection pressure.

The drawdown pressure may provide or induce a radial force, such as an inwardly or outwardly radial force at the wellbore, or near-wellbore formation (e.g., an inward force from the reservoir into the wellbore for production, and an outward radial form during injection). The drawdown pressure may be considered to be roughly the same around the wellbore (e.g., evenly distributed around the circumference of the wellbore).

In some embodiments, the method may include selecting both the exertive force to apply at a wellbore together with a drawdown pressure at the wellbore, in order to modify operations at a the formation. In other words, the method may include selecting the exertive force to apply at a wellbore and selecting a corresponding drawdown pressure.

In that case, the selection of exertive force and drawdown pressure may both be based on the downhole environment at the wellbore.

In some embodiments, one or both of the exertive force and drawdown pressure may be constrained, for example, due to constraints of equipment, wellbore, reservoir, or limitations thereof. In such cases, there may be an upper and/or lower limit, or only a particular exertive force or drawdown pressure to select. In those cases, the method may include selecting both the exertive force to apply at a wellbore together with a drawdown pressure at the wellbore, based on a constrained exertive force or drawdown pressure, as well as the downhole environment at the wellbore.

The downhole environment may be known (e.g., measured), expected, estimated, predicted (e.g., simulated), guessed, etc., or combination therefore. For example, some, or all, of the downhole environment may be determined from logging data, seismic data geophysical data, or the like.

The downhole environment—or data associated with the downhole environment—may include properties at the wellbore. The properties may be associated with the formation, such as the rock formation. The properties may include one or more of: porosity, permeability, formation strength, Biot Coefficient, friction angle, Young's modulus, Poisson's ratio, etc. The properties (e.g., porosity, permeability, etc.) may be existing properties (e.g., the present porosity) or expected properties (e.g., future porosity based on the life cycle, or predicted future state, of the wellbore).

The downhole environment may include conditions at the wellbore. The conditions may be associated with the formation, such as the rock formation, of the reservoir. The conditions may be associated with the configuration of the wellbore. The conditions may include one or more of: a stress state within the formation (e.g., being in a state of dilation, compaction, or extension, etc.); the differential stresses and/or effective mean stresses in the formation; stresses at the wellbore (e.g., tangential stresses, radial stresses); stresses at equipment, such a casing, at the wellbore; pressures within the formation; pressures within the wellbore; temperature at the wellbore; well configuration (e.g., radius, deviation, azimuth, etc.), etc. The conditions (e.g., the stress state) may be existing conditions (e.g., the present stress state) or expected condition (e.g., a future stress state based on depletion, or predicted depletion from the reservoir).

Some, or all, of one or both of the conditions and properties of the downhole environment may be associated with the environment of a near-wellbore formation. The near-wellbore formation may be considered to be a region extending into the formation around some or all of the wellbore (e.g., radially extending around some or all of the wellbore). The near-wellbore formation may be considered to be the region extending up to at least a tenth of a diameter of the wellbore into the formation. In some examples, the near-wellbore formation may be considered to be the region extending up to at least a quarter, or even a half, of a diameter of the wellbore into the formation. In some further example, the near-wellbore formation may extend up to at least one-times the diameter of the wellbore. For example, a wellbore may have a diameter of roughly 20 cm (8 inches). As such, the near-wellbore formation may be considered to be the region extending up to at least 20 cm (8 inches) around some or all of the wellbore. The near-wellbore formation may be considered to be the region extending up to at least 1.6, or up to at least 1.8 times the diameter of the wellbore.

The near-wellbore formation may be considered to be the region extending up to at least three times the diameter of the wellbore. In the example as above, the near-wellbore formation then may be considered to be the region extending up to at least 60 cm (24 inches) around some or all of the wellbore. So, for example, the downhole environment may have stresses, such as one or both of the effective and differential stresses, in the near-wellbore formation (i.e., these stresses extending at least up to three times the diameter of the wellbore into the formation surrounding some or all of the wellbore). Similarly, the near-wellbore formation may have a particular stress state, such as being in compaction.

The near-wellbore formation may be considered to be the region extending at least up to about 1 meter, or at least up to about 2 meters, around some or all of the wellbore.

The exertive force may provide a force per unit area (i.e pressure) greater than about 0.5 MPa, or greater than 1 MPa, for example, greater than about 2 MPa, or greater than 5 MPa. The exertive force may provide force per unit area (i.e pressure) up to 30 MPa. Of course, the exertive force may provide a pressure greater than 30 MPa.

One, or both, of the exertive force and drawdown pressure may be selected in order to modify, such as increase, the porosity of the near-wellbore formation that surrounds some or all of the wellbore. One, or both, of the exertive force and drawdown pressure may be selected to modify, such as increase, the permeability of the near-wellbore formation (e.g., when compared to applying no exertive force at the wellbore). One or both of the exertive force and drawdown pressure may be selected in order to modify the porosity and/or permeability of the formation at the near-wellbore from an initial or current porosity/permeability, or from an expected porosity/permeability (e.g., after a period of depletion from the reservoir). One or both of exertive force and drawdown pressure may be selected so as to maintain the porosity and/or permeability of the near-wellbore formation. One or both of the exertive force and drawdown pressure may be selected so as to reduce, or minimise, any change in porosity and/or permeability of the near-wellbore formation, during production from the reservoir.

The exertive force (and drawdown pressure) may be selected in order to provide, or induce, a particular stress state in the formation, or near-wellbore formation. The exertive force may be selected in order to increase, reduce, or maintain a particular stress state in the formation, or near-wellbore formation. The stress states may include dilation, compaction, or extension.

The exertive force may be for application from the wellbore to the formation or near-wellbore formation (e.g., a force applied to a wall defining the wellbore). The exertive force may include an outwardly radial force (e.g., a radial force from the wellbore to the near-wellbore formation). The exertive force may be perpendicular to the wall defining the wellbore. The exertive force may include an outwardly axial force (e.g., an axial force from the bottom region of the wellbore to the near-wellbore formation).

The exertive force may for application from the wellbore to the formation, or near-wellbore formation, as a force per unit area at the wellbore (or wall defining the wellbore). The exertive force may for application from the wellbore to the formation, or near-wellbore formation, as pressure (e.g., as an exertive pressure applied to a wall defining the wellbore).

The exertive force may be for application from the wellbore to the formation, via intermediate apparatus. For example, such intermediate apparatus may include a sand screen, frac and pack, gravel pack, etc. In some examples, the exertive force may be applied to the intermediate apparatus, which in turn may, or may not, transmit through to the formation. In other words, for example, the selection of exertive force and drawdown pressure may be used to modify the porosity, or the like, of an intermediate apparatus. In such further examples, the intermediate apparatus may be considered to form some or all of the near-wellbore formation.

The exertive force may be selected as to apply a similar force (or pressure) around some or all of the wellbore (e.g., roughly the same force or pressure applied around a circumference of the wellbore). The exertive force may be selected as to provide or induce a similar stress state around some or all of the wellbore (e.g., roughly the same stress state around the wellbore in the near-wellbore formation).

The exertive force may be selected to provide different forces (or pressures) around some or all of the wellbore (e.g., different forces or pressures applied at different regions of wall defining the wellbore). The exertive force may be selected so as to provide or induce different stress states around some, or all, of the wellbore (e.g., different stress states around the wellbore in the near-wellbore formation). The exertive force may be selected based on a desired stress state around some, or all, of the wellbore. The selection of exertive force to provide or induce different stress states may be based on one or both of different properties and conditions of the downhole environment at the wellbore (e.g., different rock properties surrounding the wellbore in the near-wellbore formation).

The selected exertive force may differ around the wellbore (e.g., differing pressures around the wellbore), so as to induce different levels of stress (or porosity/permeability) in the near-wellbore formation. Alternatively, the exertive force may differ around the wellbore (e.g., differing pressures) so as to induce a similar stress state (or porosity/permeability) in the near-wellbore formation, for example, when the initial stresses in the near-wellbore formation may be considered heterogeneous, or anisotropic.

The selection of the exertive force may be based on the particular fluids being used (e.g., produced from) at the wellbore. For example, the exertive force may be selected to induce a particular stress state at one region of the wellbore and another particular stress state at another region of the wellbore. The method may include selecting a particular exertive force to reduce the production of, for example, water from one region of the wellbore, and selecting an further exertive force to assist with production of, for example, oil from another region.

The exertive force may be considered to provide or induce mechanical stress (e.g., mechanical stress in the near-wellbore formation). The drawdown pressure may be considered to provide or induce a hydraulic pressure (e.g., a hydraulic pressure between the near-wellbore formation and the wellbore). The drawdown pressure may be considered to induce a mechanical stress in the near-wellbore formation.

The selection of one or both of the exertive force and drawdown pressure may be based on the expected lifetime of the wellbore. One or both of the selected exertive force and drawdown pressure may be modified, or reviewed, from time to time (e.g., periodically, such as monthly, yearly, etc.) at some point during the lifetime of the wellbore. For example, in some cases, the downhole environment may be measure, or predicted, from time to time and, if helpful, one or both of the selected exertive force and drawdown pressure may be varied, based on that determined or predicted downhole environment at the wellbore.

The method may include applying a selected exertive force at the wellbore. The application may include using downhole apparatus to apply the selected exertive force (e.g., apply an exertive pressure at a wall defining the wellbore to induce a particular stress state within the near-wellbore formation). The apparatus may include tubing. The tubing may be for use in lining drilled wellbores, such as those used when accessing reservoirs. The apparatus may include a base pipe. The base pipe may include a plurality of fluid pressure deformable chambers, for example, mounted on an exterior of the pipe. The pipe may include a conventional oil field tubular, which has been modified. The chambers may each be defined by a tubular member. The tubular members may be spaced around the circumference of the base pipe (e.g., equally spaced). The tubular members may extend axially along some, or all, of the base pipe.

The method may include inflating the chambers with fluid or gas in order to provide particular exertive force to near-wellbore formation. The method may include providing the same, or different, force (e.g., pressure) via each inflatable chamber. The differing force (e.g., differing pressures) may be used in induce different stress states (or porosity/permeability) in different sections of the near-wellbore formation, for example, when the near-wellbore formation may be considered roughly homogenous, or isotropic. The differing force (e.g., differing pressures) may be used in induce a similar stress state (or porosity/permeability) in the near-wellbore formation, for example, when the near-wellbore formation may be considered roughly heterogeneous, or anisotropic. The method may include applying the selected drawdown pressure at a wellbore.

The method may include producing from the wellbore/formation. The method may including injecting (e.g., injecting water, fracture fluids, or the like) at the wellbore/formation.

According to a further embodiment, the method includes selecting an exertive force to apply at a wellbore, together with a fluid pressure at the wellbore in order to modify production from a reservoir, the fluid pressure being the differential static pressure between the reservoir and the wellbore, such as between the reservoir and the wellbore at a production zone, which causes fluid to flow between reservoir and the wellbore, the selection of one or both of the exertive force and drawdown pressure being based on the downhole environment at that wellbore.

According to a further embodiment, the method includes selecting an exertive force to apply at a wellbore, together with a fluid pressure at the wellbore in order to modify production from a reservoir, the fluid pressure being the differential pressure between the reservoir static pressure and the wellbore flowing pressure, such as between the reservoir and the wellbore at a production zone during flow conditions, which causes fluid to flow between reservoir and the wellbore, the selection of one or both of the exertive force and drawdown pressure being based on the downhole environment at that wellbore.

According to a further embodiment, there is a method including selecting both an exertive force to apply at a wellbore together with a drawdown pressure at the wellbore, in order to modify production from a reservoir, the selection of exertive force and drawdown pressure being associated with the downhole environment at the wellbore.

According to a further embodiment, there is a method including selecting both an exertive force to apply at a wellbore together with an injection pressure at the wellbore, in order to modify injection at a subterranean formation, the selection of exertive force and injection pressure being associated with the downhole environment at the wellbore.

The injection pressure may be considered to be associated with a pressure at which fluids, such as water, fracture fluids, or the like, are injected into a formation at the wellbore. The injection pressure may be associated with a particular injection force, per unit area. The injection pressure may be considered to be the differential pressure between the static pressure in reservoir, or at least the near-wellbore formation (e.g., when the well is not producing), and the wellbore at an injection zone, when injecting (e.g., at a region where water, or the like, leaves the wellbore to the formation).

The injection pressure may be considered to be a negative drawdown pressure.

According to a further embodiment, there is a method including applying both an exertive force at a wellbore together with a corresponding drawdown pressure at the wellbore, in order to modify operation at a subterranean formation.

The applied exertive force and drawdown pressure may be associated with, or determined from, the downhole environment at the wellbore.

According to a further embodiment, there is a method including applying both an exertive force at a wellbore together with a corresponding injection pressure at the wellbore, in order to modify injection at a subterranean formation.

According to a further embodiment, there is a method including selecting both an exertive force to apply at a wellbore together with an drawdown pressure at the wellbore, in order to modify operations at a subterranean formation, the selection of exertive force and drawdown pressure being associated with conditions at the wellbore and properties at the wellbore.

According to a further embodiment, there is a method including determining one of an exertive force or a drawdown pressure to apply at a wellbore in order to modify operations at a subterranean formation.

Operations may include production of fluid from the wellbore and/or and injection of fluid at the wellbore.

The determination of exertive force or drawdown pressure may be based on a constrained drawdown pressure or exertive force being applied, or to be applied, at a wellbore, together with the downhole environment at the wellbore (e.g., one, or both, of conditions and properties at the wellbore).

The method may include determining both the exertive force to apply at a wellbore, and drawdown pressure, in order to modify operations at a subterranean formation.

According to a further embodiment, there is provided method of data compilation in order to modify operations at a subterranean formation.

Operations may include production of fluid from the wellbore and/or and injection of fluid at the wellbore.

The method may include compiling data associated with a downhole environment of a wellbore, for use in selecting one or both of and exertive force and drawdown pressure to apply at a wellbore. The method may include measuring data, for example, at the wellbore. The method may include storing data, such as on a downhole environment database.

Any of the aforementioned embodiments may be provided using provided using at least one processor. For example, the selection, determination, or compilation, of one or both of the exertive force and the drawdown pressure in the above embodiments may be provided using at least one processor. The at least one processor may be configured for use with memory (such as volatile, non-volatile memory, etc). The selection, determination, etc. may be performed using hardware and/or in software (including firmware, resident software, micro-code, etc.) that runs on the at least one processor. In some cases, this may be collectively referred to as "circuitry," "a module" or variants thereof. The at least one processor may be configured with a Digital Signal Processor, Application Specific Integrated Circuit, Field Programmable Gate Array, Programmable Intelligent Computer, microcontroller, or the like. The at least one processor may be configured with dedicated apparatus (including downhole equipment and tools), general purpose apparatus, such as a personal computer, handheld device (e.g., multimedia device, such as a person digital assistant, tablet, etc.), or the like.

According to a further embodiment, there is a computer program, for modifying operations at a subterranean formation.

The computer program may be configured to provide the method of any of the above described aspects or embodiments. The computer program may be provided on a computer readable medium. The computer program may be a computer program product. The product may include a non-transitory computer usable storage medium. The computer program product may have computer-readable program code embodied in the medium configured to perform the method. The computer program product may be configured to cause at least one processor to perform some or all of the method.

According to a further embodiment there is provided apparatus for modifying operations, such as fluid production and/or injection, at a subterranean formation.

The apparatus may include at least one processor. The at least one processor may be configured for use with memory (such as volatile, non-volatile memory, etc). The apparatus may include hardware and/or in software (including firmware, resident software, micro-code, etc.) that runs on the at least one processor. In some cases, this may be collectively referred to as "circuitry," "a module" or variants thereof. The apparatus may be configured with a Digital Signal Processor, Application Specific Integrated Circuit, Field Programmable Gate Array, Programmable Intelligent Computer, microcontroller, or the like. The apparatus may be configured as dedicated apparatus (including downhole equipment and tools), general purpose apparatus, such as a personal computer, handheld apparatus (e.g., multimedia device, such as a person digital assistant, tablet, etc.), or the like.

The apparatus may be configured to determine one or both of an exertive force to apply at a wellbore together with a drawdown pressure, or injection pressure, at the wellbore, in order to modify operations, including fluid production and/or injection, at a subterranean formation. The apparatus may be configured to base the determination of one or both exertive force and drawdown pressure on a particular downhole environment at the wellbore (e.g., a determined, estimated, known, predicted, etc., downhole environment).

The apparatus may be configured to base the determination of one or both exertive force and drawdown/pressure on particular conditions at the wellbore and/or properties at the wellbore.

The apparatus may be in communication with a database, and configured to receive data associated with a downhole environment. The apparatus may be configured to measure, or determine, predict (e.g., simulate), a downhole environment, in order to provide data associated with a downhole environment.

According to a further embodiment, there is provided apparatus configured to apply an exertive force at a wellbore in order to modify operations at a subterranean formation. The exertive force may be based on a drawdown pressure and downhole environment at a wellbore.

The apparatus may be configured to apply one or both of an exertive force and drawdown pressure, in order to modify operations at a subterranean formation. One or both of the exertive force and drawdown pressure may be selected, or determined, for example, based on a downhole environment at a wellbore.

The apparatus may be configured to control one or both of the exertive force and drawdown pressure, in order to modify operations at the subterranean formation.

The apparatus may include tubing. The tubing may be for use in lining drilled wellbores, such as those used when accessing reservoirs. The apparatus may include a base pipe. The base pipe may include a plurality of fluid pressure deformable chambers, for example, mounted on an exterior of the pipe. The pipe may include a conventional oil field tubular, which has been modified. The chambers may each be defined by a tubular member. The tubular members may be spaced around the circumference of the base pipe (e.g., equally spaced). The tubular members may extend axially along some, or all, of the base pipe.

The apparatus may be configured to allow for inflating the chambers with fluid or gas in order to provide particular exertive force to a near-wellbore formation. The apparatus may be configured to provide the same, or different, force (e.g., pressure) via some or all inflatable chambers. Differing forces between chambers (e.g., differing pressures) may be used in induce different stress states in a near-wellbore formation, for example, when a near-wellbore formation may be considered roughly homogenous, or isotropic.

The differing force (e.g., differing pressures) may be used in induce a similar stress state in the near-wellbore formation, for example, when the near-wellbore formation may be considered roughly heterogeneous, or anisotropic. The apparatus may be configured to apply a particular drawdown pressure at a wellbore.

The apparatus may be configured to measure, or determine, the downhole environment, in order to select or determine the exertive force and/or downhole pressure.

The apparatus may include a sand filter. The apparatus may include a weave, which may be configured as a sand filter.

According to a further embodiment, there is provided a subterranean formation, such as a reservoir, having at least one wellbore, the at least one wellbore including apparatus configured to modify operations at the subterranean formation.

The apparatus may be configured to apply a selected, or determined, exertive force at the wellbore in order to modify operations at the formation. The apparatus may be configured to apply a particular (e.g., selected, determined, etc.) drawdown pressure, in order to modify operations at the formation. The apparatus may be configured to apply a particular exertive force based on a particular drawdown pressure. The particular exertive force and drawdown pressure may be associated with the downhole environment at the wellbore and formation properties.

The invention includes one or more corresponding aspects, embodiments or features in isolation or in various combinations whether or not specifically stated (including claimed) in that combination or in isolation. For example, features associated with particular recited embodiments relating to methods, may be equally appropriate as features of embodiments relating specifically to apparatus, reservoirs, or the like.

It will be appreciated that one or more embodiments/aspects may be useful in assisting with production from a reservoir. One or more embodiments/aspects may be useful in modifying operations at a subterranean formation, such as a reservoir.

The above summary is intended to be merely exemplary and non-limiting.

BRIEF DESCRIPTION OF THE FIGURES

A description is now given, by way of example only, with reference to the accompanying drawings, in which: —

DESCRIPTION OF SPECIFIC EMBODIMENTS

Figure 1A:
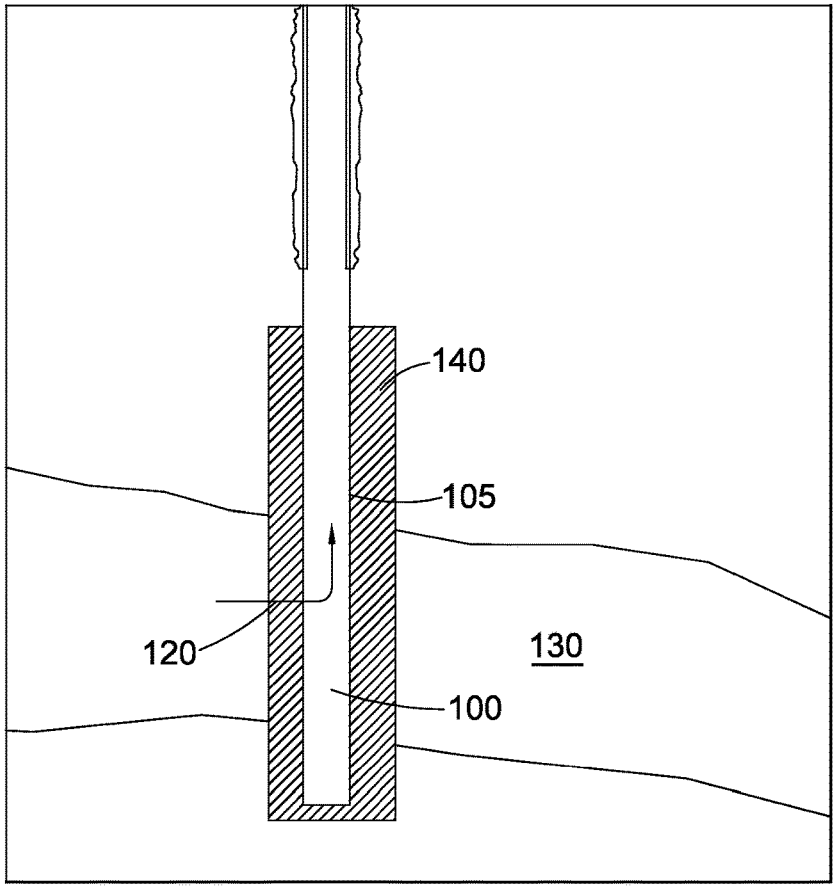
FIGS. 1*a* and 1*b* shows simplified sections of a wellbore.
Figure 1B:
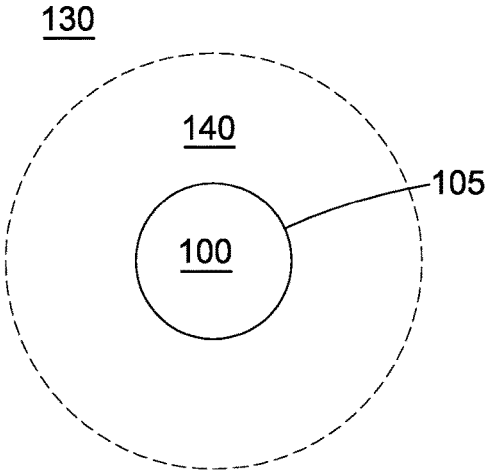

FIG. 1*a* shows a simplified section of a wellbore 100 that has been drilled into or through rock formation having a reservoir 130. For the following description, reference is made to a hydrocarbon reservoir (e.g., an oil and/or gas field). However, the reservoir 130 may equally be subterranean water reservoir (e.g., potable water), or the like. FIG. 1*b* shows a plan section of the wellbore of FIG. 1*a*. By way of an example only, the following embodiments have be described in relation to producing from the reservoir 130, in other words, producing fluid, and in particular oil 120, from the reservoir 130 to the surface (not shown) by known methods. However, further embodiments include injecting fluid into the reservoir 130 from the wellbore 100 (e.g., injecting water to assist with production, and/or hydraulic fracturing fluid, etc.). Given the detailed description below, a skilled person will readily be able to implement those further embodiments.

The wellbore 100 is essentially defined by a wellbore wall 105. In this case, the wellbore 100 is cylindrical. Generally, the reservoir 130 is in a state of compression when in its natural state. The effective mean stress (e.g., the average stress, less any pore pressure, in the reservoir 130) is generally greater than any differential stress (e.g., the difference between the maximum and minimum stresses). When the wellbore 100 is initially drilled into the reservoir 130, forces acting within the rock formation such as formation stresses in a near-wellbore formation 140, which surround the wellbore 100, are modified, or redistributed. In other words, drilling of the wellbore 100 disturbs the natural state of the reservoir 130 at the near-wellbore formation 140. Beyond the near-wellbore formation 140, i.e., further into the reservoir 130, the formation is unlikely to be significantly affected by the drilling of the wellbore 100.

In addition to this, any subsequent operations that occur when using fluids 120 at the reservoir 130 have a further effect on these formation forces or stresses in the near-wellbore formation 140. For example, the removal of oil 120 from the reservoir 130 creates further stresses that, at some point, cause the formation 140 surrounding the wellbore 100 to begin to yield. Similarly, the introduction of fluids, such as water, from the well to the reservoir, can cause yielding.

As that near-wellbore formation 140 yields, it changes from a state of compression, through dilation (e.g., a moderate extension of formation matrix, which may be associated with an increase in porosity) and eventually undergoes a level of compaction (e.g., full or partial collapse of the formation matrix 140). The yielding process can cause numerous effects on the formation such as the release of formations fines, the mobilisation of sand, and the near-wellbore formation 140 may start to transmit loads to the wellbore 100 (e.g., equipment, or intermediate apparatus, such as gravel packs, or the like, that may be present in the wellbore 100, including completion equipment, etc.). Furthermore, the porosity and permeability of the near-wellbore formation 140 is affected. In the example of removing oil from the wellbore, all of these factors can reduce the ability to operate, and produce from, the reservoir 130.

In some cases, the near-wellbore formation 140 can be approximated to be that region of reservoir 130, or formation, which extends at least up to 1.6 times the diameter of the wellbore 100, from the wellbore (i.e., the formation that extends radially for 1.6 times the diameter of the wellbore outwardly from the wall 105 of the wellbore 100). Of course, differing rock formations may have different extents of near-wellbore formations 140. In some further examples, the near-wellbore formation 140 may be considered to extend at least up to one tenth of the diameter of the wellbore 100, from the wellbore 100, or at least up to one quarter, or even at least up to one half of the diameter of the wellbore, from the wellbore. In some further cases, it has been considered that the near-wellbore formation may be that formation that extends at least up to three times the diameter of the wellbore, from the wellbore.

Figure 2A:
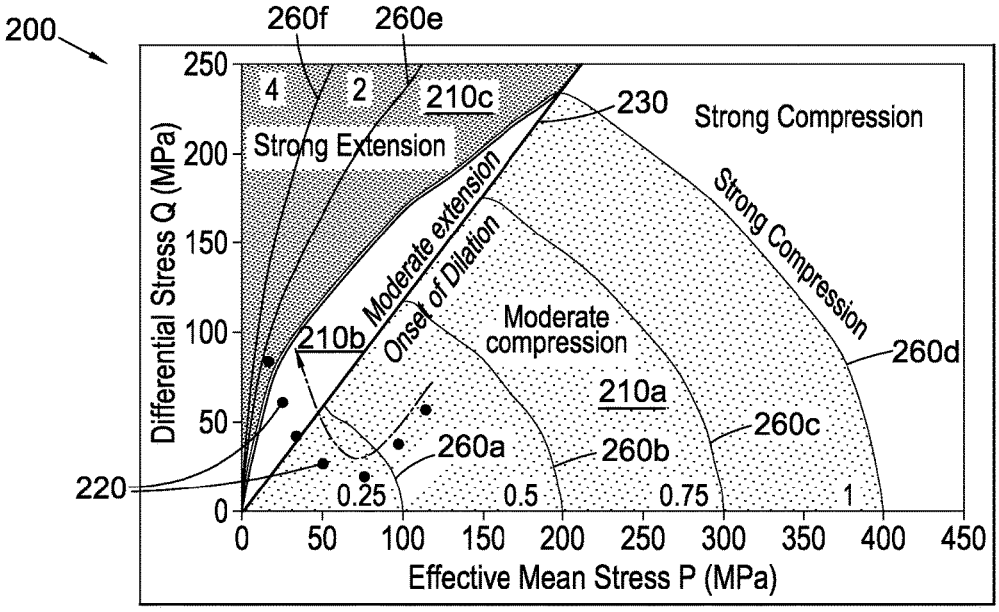
FIG. 2*a* shows an exemplary plot of the effective mean stress, P' against the differential stress, Q, that can be present in a near-wellbore formation.

FIG. 2*a* shows an exemplary plot 200 of the effective mean stress, P', against the differential stress, Q, that can be present in a near-wellbore formation 140. The plot 200 can be considered applicable to a broad range of differing types of formation. The stress plot shown FIG. 2*a* is consistent with the teaching from, for example, the paper, "*Two-phase damage theory and crustal rock failure: the theoretical 'void' limit, and the prediction of experimental data*"; Ricard, Yanick and Bercovici, David; Geophysical Journal International; Nov. 18, 2003; vol. 155; pp 1057-1064, which is incorporated herein in its entirety. The effective mean stress can be considered to be, $$P' = \frac{\sigma_1 + \sigma_2 + \sigma_3}{3} - P_o$$

where $\sigma_1$, $\sigma_2$ and $\sigma_3$ are the stresses in three principal planes (e.g., vertical plane, and two horizontal planes), and $P_o$ is the pore pressure. The differential stress can be considered to be, $$Q = \sigma_1 - \sigma_3$$

where $\sigma_1$, is the stress of a particular principal plane that is comparatively the largest, and $\sigma_3$ is the stress of a further particular principal plane that is comparatively the smallest. The differential stress can provide an indication of the overall difference between stresses in the near-wellbore formation 140. Redistribution of these stresses during lifespan of the wellbore, for example, due to the effects of reservoir 130 depletion (e.g., reduction in pore pressure) and/or drawdown, can cause an increase in the differential stress at the formation. A high differential stress can, in some cases, overcome the strength of the formation matrix.

In that case, the formation 140 will generally have passed from the state of compression 210*a*, through to dilation 210*b*, into the state of so-called strong extension/compaction 210*c*. In the state of extension 210*c*, production from the reservoir 130 may be limited because the formation becomes compacted. That is to say that the grains of rock in the near-wellbore formation 140 are compacted together, reducing porosity and permeability. As the near-wellbore formation 140 begins to lose its structure, particulates of sand may mobilize and/or re-sort, which can ultimately result in a reduction in production. This can also result in wear and tear on components of the production equipment. Exemplary data points 220 are shown for a particular reservoir 130, showing the transition of stress in the near-wellbore formation 140 during depletion of the reservoir. A boundary 230 between a state of compression 210*a* and a dilation 210*b*/extension 210*c* is shown on FIG. 2. In this example, the boundary 230 is approximated as a linear relationship between effective mean stress P' and differential stress Q within the near-wellbore formation. The linear boundary 230 between compression 210*a* and dilation 210*b*/extension 201*c* can be expressed as:

$$Q = C_{boundary} P' \text{ or } C_{boundary} = \frac{Q}{P'}$$

Where $C_{boundary}$ is the boundary co-efficient and, in this case, can be approximated as 1.1801. This value of boundary co-efficient is appropriate for many formations. Of course, in further examples, this may be approximated as roughly 1.18, roughly 1.2, or even 1. Where the ratio of the differential stress Q to the effective mean stress P' exceeds the boundary co-efficient, $C_{boundary}$, it can be determined that the stress state of the near-wellbore formation 140 is in a state of dilation 210*b*, or extension 210*c*. Otherwise, where the ratio of the differential stress Q to the effective mean stress P is less than the boundary co-efficient, $C_{boundary}$, it can be determined that the stress state of near-wellbore formation 140 is in a state of compression 210*a*.

It will be appreciated that the stress state for each particular near-wellbore formation, as shown in FIG. 2*a*, will vary from reservoir 130 to reservoir 130, due to differing downhole environments at each particular wellbore 100 (e.g., differing rock type, depth, etc.). By determining (e.g., measuring, calculating, etc.) the downhole environment (e.g., conditions, properties) of a wellbore 100 (e.g., the initial or present conditions), the expected degradation, reduction in porosity and/or permeability of the near-wellbore formation 140 can be determined or estimated for a given depletion from the reservoir 130. This variation in permeability can be predicted, or estimated, from data associated with the wellbore 100. This data may be logging data, data associated with experimental activity (e.g., laboratory activity), seismic data, or the like. In other words, by assessing the stress state of the near-wellbore formation 140, along with of factors associated with the downhole environment at the wellbore, it is possible to estimate, for a given depletion from the reservoir, how that stress state may vary, and so how the porosity and/or permeability of the near-wellbore formation 140 may vary.

Figure 2B:
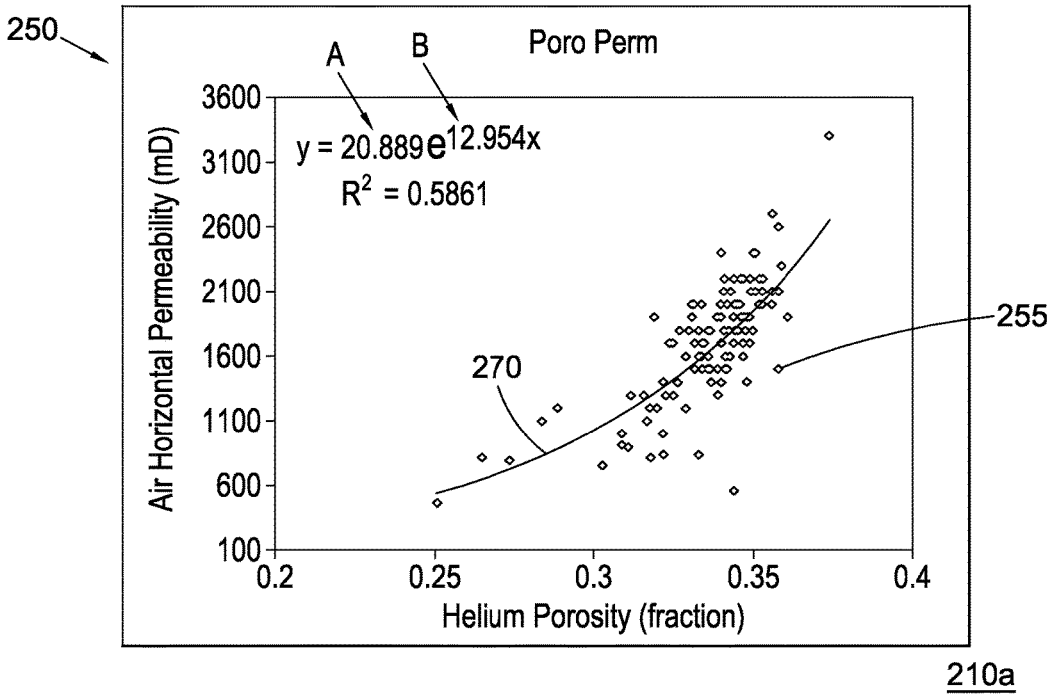
FIG. 2*b* shows an exemplary porosity-permeability relationship for a given near-wellbore formation.

Broadly speaking, each formation can have an associated porosity-permeability relationship, in which for a given porosity, the permeability (and hence the ability to produce from the reservoir 130) can be related, or estimated. Such porosity-permeability relationships can be determined by experimental means, in a known manner. FIG. 2*b* shows an exemplary porosity-permeability plot 250 for a given near-wellbore formation 140. The plot 250 shows a plurality of measured data points 255, providing a particular permeability for a particular porosity. In addition, the plot 250 shows an approximate porosity-permeability relationship 270, which in this example can be considered to be exponential, by:

$$\text{Permeability}=Ae^{B\Phi}$$

where, A and B are constants, and Φ is the porosity fraction. Differing formations may have differing porosity-permeability relationships. Broadly speaking, the greater the permeability of a near-wellbore formation 140, the easier it can be to extract, or produce from.

Due to the nature of rock structure, it might be helpful to maintain, or induce, the near-wellbore formation 140 in a particular stress state (e.g., a state of compression), for example, for as long as possible in order to assist maintaining the permeability. In some cases, it may be helpful to maintain or place the near-wellbore formation 140 in a stress state associated with a state of dilation, because the permeability of the near-wellbore formation 140 may increase in such a state. Furthermore, it may be helpful to avoid a stress state associated with significant compaction, and so avoid sand mobilisation and production. One way in which to achieve this may be to select a formation material (i.e., rock) that shows the least reduction in porosity and/or permeability as the reservoir 130 is depleted. However, in some cases, this is not possible. For example, when the reservoir 130 includes a weakly consolidated rock it might not be possible to select a site for the wellbore 100 which passes through formation that shows the least reduction in permeability with depletion. In those cases, an alternative, or complementary, solution might be useful.

Because, in this example, the wellbore 100 is essentially cylindrical, the principal stresses σ1, σ2 and σ3 will result in radial and tangential stresses being applied to the wellbore 100, or at least at the wall 105 defining the wellbore 100, or on equipment, such as completion casing, etc., in the wellbore 100. The radial and tangential stresses at the wellbore 100 from the near-wellbore formation 140 stress state can be considered to be, $$\sigma_r=P_w=P_o-DD+\text{Darcy's}$$

$$\sigma_\theta=\sigma_H+\sigma_h-(P_o-DD+\text{Darcy's})-2(\sigma_H-\sigma_h)\cos(2\theta)-4\tau_{Hh}\sin(2\theta)$$

where, $P_w$ is the pressure in the wellbore 100 while flowing at a given drawdown, $P_o$ is the pore pressure, DD is the so-called drawdown pressure (i.e., the positive pressure differential between the static pressure in the reservoir and the pressure in the wellbore, for example, at a production zone, which generally causes fluids from the reservoir 130 to flow into the wellbore when the well begins to produce), $\sigma_H$ is the maximum horizontal stress, $\sigma_h$ is the minimum horizontal stress, $\tau_{Hh}$ is the shear stress, and θ is the angle around the wellbore 100 being considered.

Further, Darcy's is an exertive force, which in this case is provided per unit area (i.e., exertive pressure), that is provided from the wellbore 100—or wall 105—to the near-wellbore formation 140 (e.g., in addition to any hydrostatic pressure). The exertive force may apply a force per unit area (i.e., pressure) greater than about 0.25 MPa, such as greater than 0.5 MPa, or greater than 1 MPa, for example, greater than about 2 MPa, or even greater than 5 MPa. In some examples, the exertive force may provide force per unit area (i.e., pressure) of up to 30 MPa. Of course, the exertive force may provide a pressure greater than 30 MPa.

These stresses can be represented in the P and Q domain (i.e., effective and differential stress), but in a cylindrical manner, by considering that the effective radial and tangential stresses can be considered to be, $$\sigma'_r=\sigma_r-\beta P_o$$

$$\sigma'_\theta=\sigma_\theta-\beta P_o$$

Where β is the Biot Coefficient, and represents the change in poroelastic properties of the formation when stresses are applied to it. The Biot Coefficient can be determined or estimated for different formations, in a known manner.

In cylindrical coordinates, the cylindrical differential stress can be shown to be, $$P'=\frac{(\sigma'_\theta+\sigma'_r)}{2}$$

and the cylindrical effective mean stress can be considered to be, $$Q'=\sqrt{1.5((\sigma'_\theta-P')^2+(\sigma'_r-P')^2)}$$

As explained above in relation to FIG. 2*a*, in some cases a near-wellbore formation 140 may have a stress state that is in a state of compression 210*a*, dilation 210*b*, or extension 210*c*. It is possible to determine from both the differential stress and the effective mean stress in which stress state the near-wellbore formation 140 is presently. Based on the particular downhole environments at the wellbore 100, such as conditions at the near-wellbore formation 140, it can be shown that the porosity of near-wellbore formation 140 can be modified by the following, $$\phi_{Change} = \frac{\left(0.375\left(\left(\frac{\sigma'_\theta - a(P_{Hyd} - DD + \text{Darcy's}) + \alpha\beta P_o}{2}\right)^2 + \left(\frac{a(P_{Hyd} - DD + \text{Darcy's}) - \alpha\beta P_o - \sigma'_\theta}{2}\right)^2\right)\right)}{\left(f_{dilation} P^{\wedge}\left(\left(\frac{\sigma'_\theta + a(P_{Hyd} - DD + \text{Darcy's}) - \alpha\beta P_o}{2}\right) + P_\gamma\right)\right)}$$

where,

| | | | |
|---|---|---|---|
| $a$ | Conversion Factor from *psi* to *MPa* | $f_{dilation}$ | Dilation Coefficient |
| $\sigma_\theta$ | Tangential stress (*psi*) | $\sigma'_\theta(Mpa) = a(\sigma_\theta - \beta P_o)$ | |
| $\beta$ | Biot Coefficient | $P^{\wedge}(Mpa) = \frac{65}{\emptyset_{original}}$ | |
| $P_o$ | Pore Pressure (*psi*) | $P_\gamma(Mpa) = 0.02P^*$ | |
| $P_{Hyd}$ | Hydrostatic Pressure (*psi*) | | |
| $DD$ | Drawdown (*psi*) | | |

Again Darcy's is the exertive force, provided per unit area (i.e., exertive pressure), and further $f_{dilation}$ is a dilation coefficient based on the differential stress and the effective mean stress.

As mentioned, the exertive force (i.e., Darcy's) may apply a force per unit area (i.e., pressure) greater than about 0.25 MPa, such as greater than 0.5 MPa, or greater than 1 MPa, for example, greater than about 2 MPa, or even greater than 5 MPa. In some examples, the exertive force may provide force per unit area (i.e., pressure) of up to 30 MPa. Of course, the exertive force may provide a pressure greater than 30 MPa.

To understand this change in porosity further, consider FIG. 2*a*, an example of a near-wellbore formation having a differential stress of 150 MPa, and an effective mean stress of 200 MPa. In that situation, the ratio of the differential stress to effective mean stress is 0.75, which is less that the given boundary co-efficient of 1.1801. Therefore, the formation can be considered to be in a state of compression 210*a*. In this state, it may be possible to change, or modify, the stress state of the near-wellbore formation 140 from a state of compression to a state of dilation. The dilation co-efficient (many of which are shown as 0.25, 0.5, 0.75, and 1 on FIG. 2*a* at 260*a*-260*d*) can be determined from at the intersection of the particular differential stress and the effective mean stress. In this example, the dilation co-efficient can be considered to be approximately 0.75. Of course, is some cases, the particular dilation co-efficient may be appreciated roughly to 0.25, 0.5, 0.75, and 1, or may be determined more precisely, for example, by interpolating the dilation co-efficient for a particular differential and effective mean stress.

With these conditions determined, the porosity of the near-wellbore formation 140 can be considered to be a function of firstly the drawdown pressure, DD, and secondly the exertive force, or exertive force per unit area (e.g., exertive pressure, Darcy's) that is applied at the wellbore. As mentioned, the permeability of the near-wellbore formation 140 can affect production from the reservoir 130, and that the permeability is a function of the particular conditions and properties of the formation (e.g., rock type, etc.) and the porosity of the near-wellbore formation. Therefore, a preferable porosity, and as such a preferable permeability, can be provided by selecting both the exertive force and the drawdown pressure to apply at the wellbore 100.

It will be appreciated that in some cases, the porosity and/or permeability may be essentially maintained, as the increase in porosity merely offsets any reduction due to production/depletion.

Therefore, by selecting both the exertive force and the drawdown pressure for particular downhole environment at a wellbore, the permeability of the near-wellbore formation 140 can be maintained, or modified, so as to maintain or improve production from the wellbore. In some cases, the exertive force and the drawdown pressure for particular downhole environment at a wellbore may be selected so as to increase the cumulative output from the reservoir over the life of the of wellbore.

In addition, it is possible to select both the exertive force and the drawdown pressure for the particular downhole environment at a wellbore throughout the life of the well (e.g., select from time to time, such as periodically (e.g., monthly, yearly, etc.), based on revised conditions and/or properties). In such cases, the wellbore 100 may be considered to be optimized throughout the life of the well to provide improvement, maintenance, etc., of the porosity of the near-wellbore formation 140.

The same is true when the stress state of the near-wellbore formation 140 is in a state of compaction (i.e., that the ratio of differential stress to effective mean stress is greater than the boundary coefficient). However, in such cases, it can be shown that based on the particular downhole environment at the wellbore 100, the change in porosity of the near-wellbore formation 140 for a particular drawdown pressure, DD, and exertive force per unit area is, $$\phi_{Change} = \frac{\left(0.375\left(\left(\frac{\sigma'_\theta - a(P_{Hyd} - DD + \text{Darcy's}) + \alpha\beta P_o}{2}\right)^2 + \left(\frac{a(P_{Hyd} - DD + \text{Darcy's}) - \alpha\beta P_o - \sigma'_\theta}{2}\right)^2\right)\right)}{\left(f_{compaction} P^*\left(\left(\frac{\sigma'_\theta + a(P_{Hyd} - DD + \text{Darcy's}) - a\beta P_o}{2}\right) + P_\gamma - f_{compaction} P^*\right)\right)}$$

where $f_{compaction}$ is the compaction coefficient. In a similar manner to the dilation coefficient, the compaction coefficient is shown as 1, 2 and 4 on FIG. 2*a* at 260*d*-260*f*, and can be given from the differential stress and the effective mean stress in a similar manner as above.

Therefore, based the particular downhole environment at the wellbore 100, it is possible to select both exertive force to apply at a wellbore 100, and drawdown pressure, in order to change or maintain the porosity, and hence the permeability, and therefore modify production from a reservoir.

Of course, in some cases, a particular exertive force may be selected based on an existing, or required, drawdown pressure. For example, it may be that a particular drawdown pressure is required or desired for a given wellbore or reservoir (e.g., due to equipment constraints, such as choke constraints). In those cases, a particular exertive force may be selected based that required/desired drawdown pressure, together with the particulars of the downhole environment, such as the conditions or rock properties at the wellbore. In other examples, a particular drawdown pressure may be selected based on an existing, or required, exertive force. For example, it may be that a particular exertive force is required or desired for a given wellbore or reservoir (e.g., due to equipment constraints). In those cases, a particular drawdown pressure may be selected based that required/desired exertive force, together with the particulars of the downhole environment, such as the conditions or rock properties at the wellbore.

The constrained exertive force or drawdown pressure may be constrained within particular limits. For example, there may be an upper limit, and/or a lower limit, of drawdown pressure. In those cases, the exertive force may be selected based on the downhole environment at the wellbore, as well as considering the limits of drawdown pressure. Alternatively, there may be a particular drawdown pressure, or exertive force, that has to be applied. In those cases, it is possible to select a corresponding exertive force or drawdown pressure that assists with production from the reservoir.

Figure 3A:
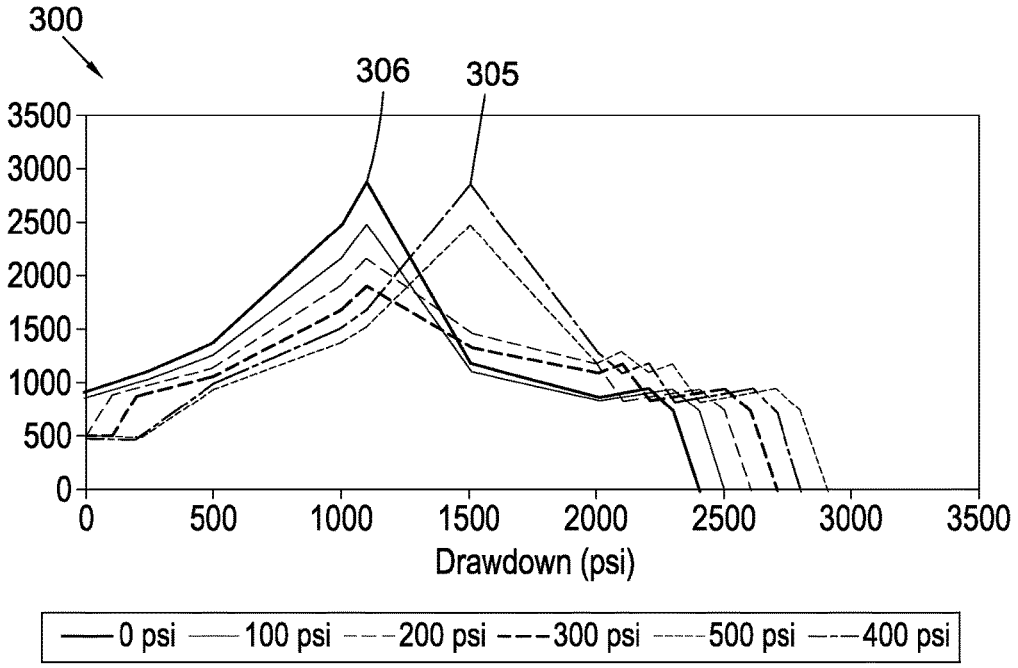
FIG. 3*a* shows a plot for a particular downhole environment of a wellbore having for example, particular conditions and reservoir properties, in which the permeability of the formation near-wellbore formation is shown against drawdown pressure for differing exertive forces.

FIG. 3*a* shows a plot 300 for a particular wellbore downhole environment (e.g., conditions and properties at the wellbore) in which the permeability (mD) of the near-wellbore formation 140, on the y-axis, is shown against drawdown pressure, for differing exertive forces, on the x-axis. This permeability (mD) is determined by first determining a change in porosity for a given drawdown pressure and given exertive force, and then associating the resultant porosity (i.e., the initial porosity and the change in porosity) with a particular permeability, taken from a permeability-porosity relationship 270 for that particular near-wellbore formation 140. The downhole environment at this exemplary wellbore is as follows:

| Description | Neumonic | Input box | Units |
|---|---|---|---|
| Type of well | Type | Vertical | |
| Depth MD | MD | 7000 | ft |
| DepthTVD | TVD | 7000 | ft |
| Wellbore Radius | Wellbore radius | 4.25 | inch |
| Deviation | Dev | 0 | deg |
| Azimuth | Azi | 0 | deg |
| Radius azimuth | RadAzi | 0 | deg |
| GR | GR | 44.157 | API |
| Shale Cutoff | Cutoff | 60 | |
| β Biot | β | 0.89 | |
| Porosity | øInitial | 0.25 | fraction |
| Poisson ratio | ν | 0.12 | |
| Friction angle | Φ | 33.07 | deg |
| Viscosity | | 0.32 | cp |
| Bo | Bo | 1 | |
| Pore pressure gradient | Po Gradient | 0.44 | psi/ft |
| σv Gradient | σv Gradient | 0.84 | psi/ft |
| σH Gradient | σH Gradient | 0.75 | psi/ft |
| σh Gradient | σh Gradient | 0.68 | psi/ft |
| Stress Regime | Stress Regime | Normal Stress | |
| Mud Weight | $P_{Hyd}$/(0.052 * TVD) | 8.47 | ppg |

So, for example, when using a drawdown pressure of 1500 psi (roughly 10.5 MPa) and an exertive force per unit area of 400 psi (roughly 2.8 MPa), and using the data above the permeability of the near-wellbore formation can be determined as follows.

The principal stresses at the near-wellbore formation can be approximated as:

$$\sigma_1=\text{TVD}(\sigma v\text{Gradient})=7000*0.84=5880\text{ psi}$$

$$\sigma_2=\text{TVD}(\sigma H\text{Gradient})=7000*0.75=5250\text{ psi}$$

$$\sigma_3=\text{TVD}(\sigma h\text{Gradient})=7000*0.68=4760\text{ psi}$$

Similarly, the pore pressure can be approximated as, $$P_o=\text{TVD}(Po\text{Gradient})=7000*0.44=3080\text{ psi}$$

The Hydrostatic Pressure, given in psi, can be determined as, $$P_{Hyd}=0.052*\text{MudWeight}*\text{TVD}=3083.08\text{ psi}$$

Were the MudWeight is given in pounds per gallon (ppg), and the TVD is given in feet (ft). As such, the conversion factor 0.052 is provided to provide the pressure as psi.

Using this data, radial stresses at the near-wellbore 140 can be determined, and it can be shown that the effective mean stress is roughly 6.04 MPa and the differential stress is roughly 19.51 MPa. At this ratio (i.e., if Q<1.1801P'), the stress state of the formation can be considered to be in a state of dilation. The appropriate dilation co-efficient can also be determined, in the manner described above, and with respect to FIG. 2*a*. In this case, a dilation coefficient approximated at 0.25 can be used. As mentioned, however, in some cases, the dilation coefficient may be interpolated.

Subsequently, the change in porosity can be determined to be roughly 0.13 (roughly 13%). Using the initial porosity, this provides a final porosity of approximately 0.38 (roughly 38%). Using the associated porosity-permeability relationship, it is possible to determine that this relates to a permeability of approximately 2874 mD. This data point is shown at reference 305 in FIG. 3*a*. The further data points for a particular near-wellbore formation 140 can be determined in a similar manner.

As can be seen, at lower drawdown pressures, using the same exertive force per unit area of 400 psi, the permeability generally remains low, but increases as the drawdown pressure increases. This is because the formation 140 experiences some dilation, and therefore increases in porosity. However, as the drawdown pressure further increases, the permeability decreases as the formation 140 experiences compaction, and eventually complete collapse, as indicated by zero permeability at around a drawdown of 2800 psi.

Figure 3B:
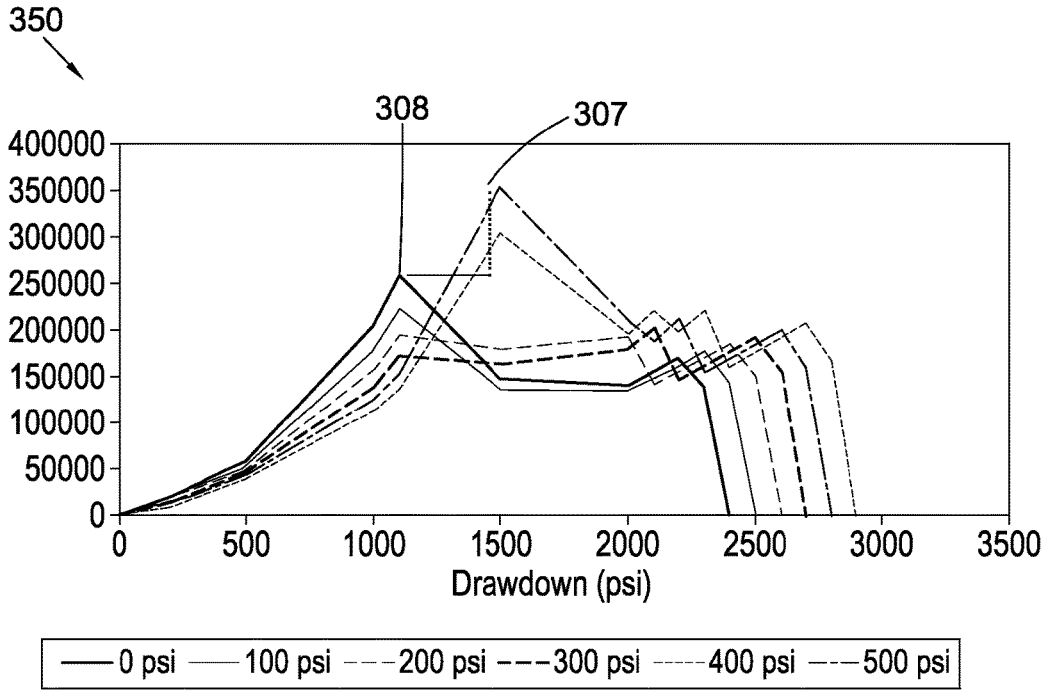
FIG. 3*b* shows corresponding flow rate from a reservoir.

It will be noted, in FIG. 3*a*, that a similar permeability can be provided when using no exertive force (see the 306 showing a permeability of roughly 2600 mD at a drawdown of around 1100 psi for 0 psi exertive force per unit area). However, consider now FIG. 3*b* which shows a plot 350 corresponding to that shown in FIG. 3*a*, in which the corresponding flow rate in barrels per day (bbl/day) is shown. As can be shown at point 307, which corresponds to point 305 in FIG. 3*a*, the bbl/day flow rate is roughly 350 k, whereas at point 308, which corresponds to point 306 in FIG. 3*b*, the bbl/day flow rate in only about 250 k. This significant difference in available flow rate is as a result of the combination of a particular drawdown pressure for a particular exertive force.

It will be appreciated that the exertive force and the drawdown pressure may be selected based on the initial downhole environment associated with the wellbore at the reservoir. However, in some cases, the exertive force and the drawdown pressure may be selected based on the expected downhole environment at one or more times during the life of the wellbore/reservoir. In other words, the exertive force and the drawdown pressure may be selected based on a future downhole environment (e.g., a predicted future stress state after a certain amount of depletion). This may provide improved production over the life of the reservoir 130. This may be useful because there would be little or no need to apply differing, or to modify, the drawdown and exertive forces during the life of the wellbore 100.

Similarly, in some cases, the exertive force and the drawdown pressure may be selected from time to time, such as periodically (e.g., annually). This modification may be based on a changing downhole environment, for example, changing conditions of the near-wellbore formation 140. In such cases, it may be possible to make assumptions regarding the downhole environment of the wellbore 100 at those intervals in order to select the exertive force and drawdown pressure. In other cases, measurements may be taken in order to determine the downhole environment at the wellbore 100.

In addition, it will be appreciated that in some further examples, the hydrostatic pressure may also be selected. While, in some examples, the true vertical depth (TVD) of the wellbore may be predetermined, a particular mud may be selected, which may provide a particular hydrostatic pressure, as will be appreciated.

In the above description, the near-wellbore 140 is used to explain the zone or region around the wellbore whose stress state can be modified by applying a stress/force (e.g., at the wellbore wall). Of course, a skilled reader will appreciate that the extent of this zone or region may depend on particular parameters that might include; the rock type, the natural stress conditions due to earth stresses, magnitude of the stress applied (either by the apparatus or by another source, for example, the hydrostatic pressure created by the fluids in the wellbore). Furthermore, the extent of the region may also vary with time (e.g., during depletion).

That being said, in some examples, the near-wellbore formation can be considered to be the region extending up to at least a tenth of a diameter of the wellbore into the formation. In further examples, it can be shown that the near-wellbore formation may be considered to be the region extending up to at least a quarter, a half, or even at least one-times the diameter of the wellbore into the formation. In some further examples, it has been shown that the near-wellbore formation may be considered to be the region extending up to at least 1.6, or up to at least 1.8 times the diameter of the wellbore.

It will be appreciated that any apparatus that is used to apply the exertive force at the wellbore differs from and downhole equipment that merely abuts, or the like, the wellbore, and, for example, does not provide an exertive force for modifying the near-wellbore formation.

Figure 4A:
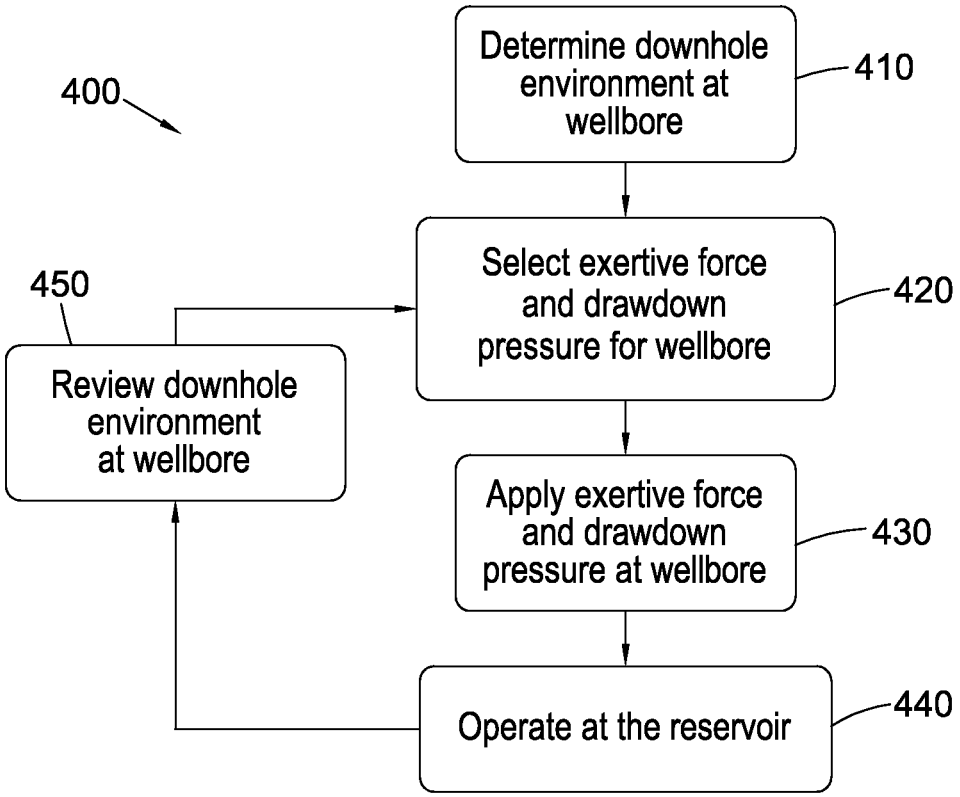
FIG. 4*a* shows a method of selecting both exertive force to apply at a wellbore, together with drawdown pressure.

FIG. 4*a* shows a flow diagram 400 of selecting the drawdown pressure and exertive force based on the downhole environment at the wellbore 100. At a first step 410, the downhole environment at the wellbore 100 is determined, for example, from using logging data, etc. to determine the near-wellbore formation 140 properties, etc. Secondly 420, an exertive force and corresponding drawdown pressure can be selected based on that initial downhole environment, or based on the expected downhole environment of the wellbore in the future, in the manner described above (e.g., after a certain amount of depletion). In a third step 430, the exertive force and drawdown pressure is applied, before operating 440, and in this example producing, at the reservoir 130. From time to time, the downhole environment can be reviewed 450 in order to select again the exertive force and drawdown pressure.

Figure 4B:
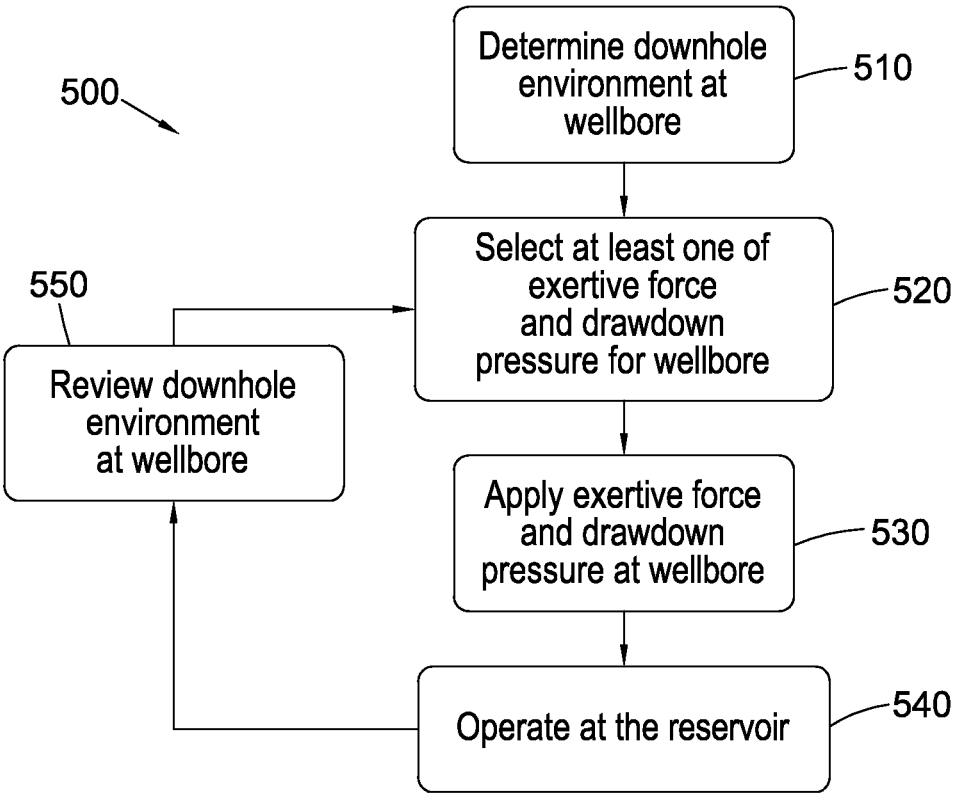
FIG. 4*b* shows a method of selecting at least one of the exertion force and drawdown pressure.

FIG. 4*b* shows similar a flow diagram 500, in which one or both of the drawdown pressure or exertive force is selected based on the downhole environment at the wellbore 100. However, in this example, one of the drawdown pressure or exertive force is constrained (e.g., within certain parameters or limits, for example by equipment constraints).

Here, at a first step 510, the downhole environment at the wellbore 100 is again determined, for example, from using logging data, etc. to determine the near-wellbore formation 140 properties, etc. Secondly 520, an exertive force, or corresponding drawdown pressure, is selected based on that initial condition—or expected environment of the wellbore in the future,—in addition to either of the constrained parameters. In other words, in some examples, a useful, or optimal, exertive force or drawdown pressure can be used, even when one of the other is constrained.

In a third step 530, the particular exertive force and drawdown pressure is applied, before operating 540, and gain in this example producing, at the reservoir 130. Again, from time to time, the downhole environment can be reviewed 450 in order to select again the exertive force and/or drawdown pressure.

Figure 5A:
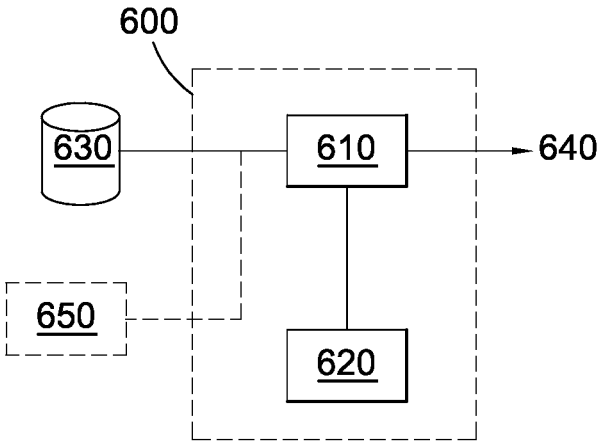
FIG. 5*a* shows apparatus for selecting exertive force and drawdown pressure.

FIG. 5*a* shows apparatus 600 for modifying operations at a reservoir, and in this example modifying production from a reservoir. The apparatus 600 includes processor 610, for use with memory 620 (e.g., volatile, non-volatile memory, etc). The processor 610 and memory are configured in a known manner. The apparatus 600 may be configured with a Digital Signal Processor, Application Specific Integrated Circuit, Field Programmable Gate Array, Programmable Intelligent Computer, microcontroller, or the like. Similarly, the apparatus 100 may be configured with dedicated apparatus. The apparatus 600 may be configured with downhole apparatus, such as completion casing, or the like. Alternatively, the apparatus 600 may be provided with a personal computer, or handheld device, such as multimedia device or tablet.

Here, the apparatus is configured to receive data associated with a downhole environment from a downhole database 630. The data stored at the downhole database 630 is that used to be able to select a particular exertive force and/or drawdown pressure, as exemplified above.

The apparatus 600 may be in communication with the downhole database 630 via a wired connection, wireless connection, or combination thereof. For example, the apparatus 600 may be in communication with the downhole database 630 via the Internet. In alternative example, the database 630 may be included with the apparatus 600 (e.g., provided with the memory 620). The apparatus further in communication with an output 640.

In use, the apparatus is configured to receive data associated with one or more particular downhole environments for one or more particular wellbores 100 from a downhole database 630. Using the method described above, the apparatus is configured to select one or both of an exertive force to apply at a wellbore together with a drawdown pressure at the wellbore, in order to modify production from a reservoir based on the data associated with the or each downhole environment.

The apparatus 600 is configured to provide the selected exertive force and drawdown pressure to the output 640. In some examples, the output may be display, memory, or the like. In further examples, the output 640 may be in communication with equipment to control production from the wellbore (e.g., downhole equipment, drawdown chokes, etc.). It will be appreciated that in example in which one of the exertive force and drawdown pressure is constrained (e.g., at a particular level), then the apparatus 600 may be configured only to provide the other, non-constrained, parameter.

In further examples, the apparatus 600 may be configured to measure, or determine, a downhole environment, in order to provide some or all of the data associated with the downhole environment. This is exemplified by a measurement device 650 in communication with the apparatus 600 by broken lines.

Figure 5B:
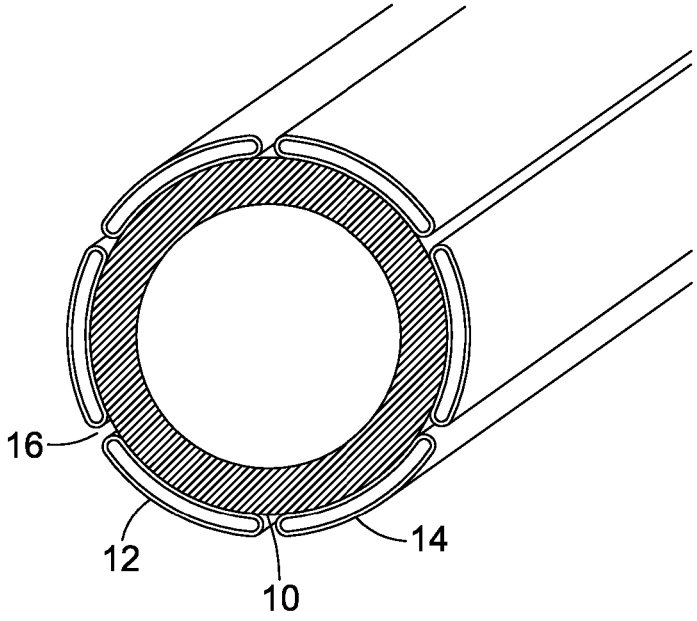
FIG. 5*b* shows downhole apparatus for applying exertive force.
Figure 5C:
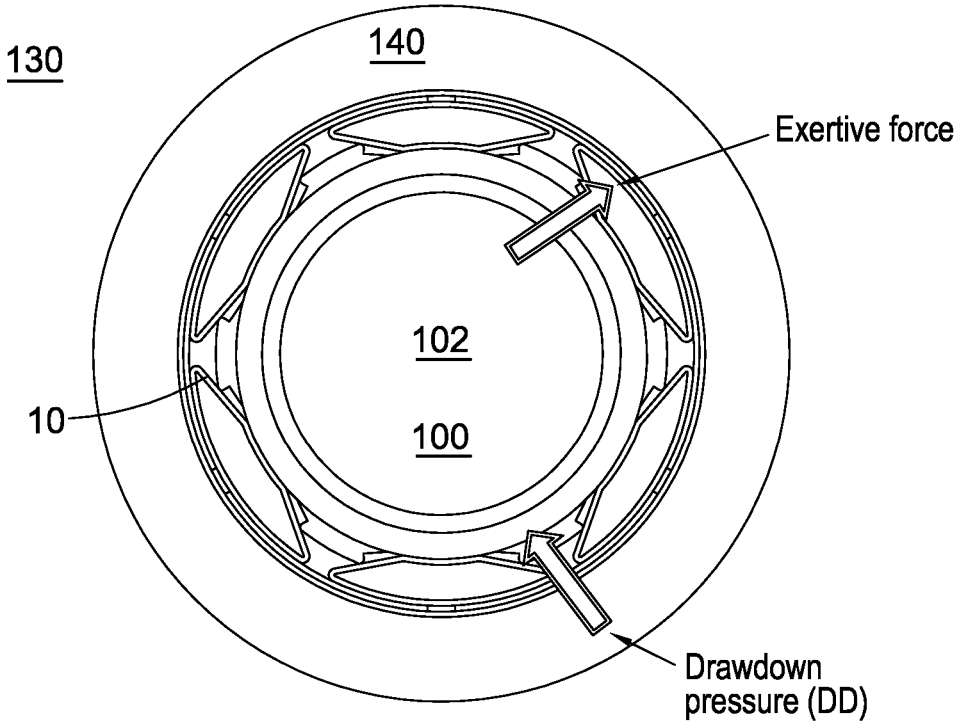
FIG. 5*c* shows the apparatus of FIG. 5*b* in situ.

FIG. 5*b* shows a sectional view of downhole apparatus 20 for applying exertive force to the near-wellbore formation 140. The apparatus 20 includes base pipe for use in lining drilled wellbores 100, such as used when access reservoirs 100. The apparatus 20 includes a rigid base pipe 10 and, in this example, a plurality of non-concentric fluid pressure deformable chambers 12 mounted on the exterior of the pipe 10. The pipe 10 may include a conventional oil field tubular, which has been modified. The chambers 12, six in this instance, are each defined by a tubular member 14. The members 14 may initially be formed as cylindrical tubes, flat plates, or the like, which, in some examples, can be formed to provide the shallow oval form as illustrated in FIG. 5*b*. The members 14 are also provided with a shallow curvature to match the circumference of the base pipe 10. In this example, the members 14 are welded to the pipe 10. In the embodiment of FIG. 5*b*, the members 14 are equally spaced around the circumference of the base pipe 10 with a small gap 16 therebetween. The members 14 extend axially along the base pipe 10, parallel to the base pipe axis. In use, some or all of the chambers may be inflated with fluid in order to provide particular radial pressure to near-wellbore formation 140. FIG. 5*c* shows a cross-sectional view of the apparatus 10 within the wellbore. Here, the drawdown pressure, DD, is illustratively shown as the pressure differential between the static pressure in the reservoir 130 and the pressure in the wellbore 100. This may be considered to be, for example, at a production zone 102. This drawdown pressure causes fluids from the reservoir 130 to flow into the wellbore when the well begins to produce.

In some examples, the apparatus 600 shown in FIG. 5*a* is in communication, or included with, the apparatus 10 of FIG. 5*b* and FIG. 5*c*.

In use, a borehole can be drilled into a formation, or subterranean reservoir, to form a wellbore. Logging, or other data capture methods, can be used to determine the downhole environment at the wellbore. From this data, a particular exertive force and drawdown pressure can be selected using the above described methods. Apparatus 20 can be run into the borehole, and deployed in order to provide the particular exertive force, etc. Fluids can then be produced from the wellbore. Subsequently, the exertive force and drawdown pressure may be modifying from time to time, based on the life characteristics of the well.

It will be appreciated that, in some further examples, the exertive force may be applied from the wellbore to the formation, via intermediate apparatus. For example, such intermediate apparatus may include a sand screen, frac-and-pack, gravel pack, etc. In some examples, the exertive force may be applied to the intermediate apparatus, which in turn may or may not transmit through to the formation. In other words, in some examples, the selection of exertive force and drawdown pressure may be used to modify the porosity, or the like, of an intermediate apparatus, so as to assist with production and/or injection. In further examples, the intermediate apparatus may be considered to form some or all of the near-wellbore formation. A skilled person will readily be able to implement such further embodiments.

In addition, in some examples, one or more of the tubular members 14 may be activated to provide an exertive force based on the particular fluids being produced from the wellbore. For example, the exertive force may be selected to apply to induce a particular stress state at one region of the wellbore and another particular stress state at another region of the wellbore. In such examples, the apparatus may be configured to selecting a particular exertive force to reduce the production of, for example, water from one region of the wellbore, and additionally/alternatively select an exertive force to assist with production of, for example, oil from another region or the wellbore.

Consider now FIGS. 6 to 26, which show embodiments and further apparatus 10 that may be used to modify operation at a reservoir, and while may be used in a wellbore 100.

Figure 6:
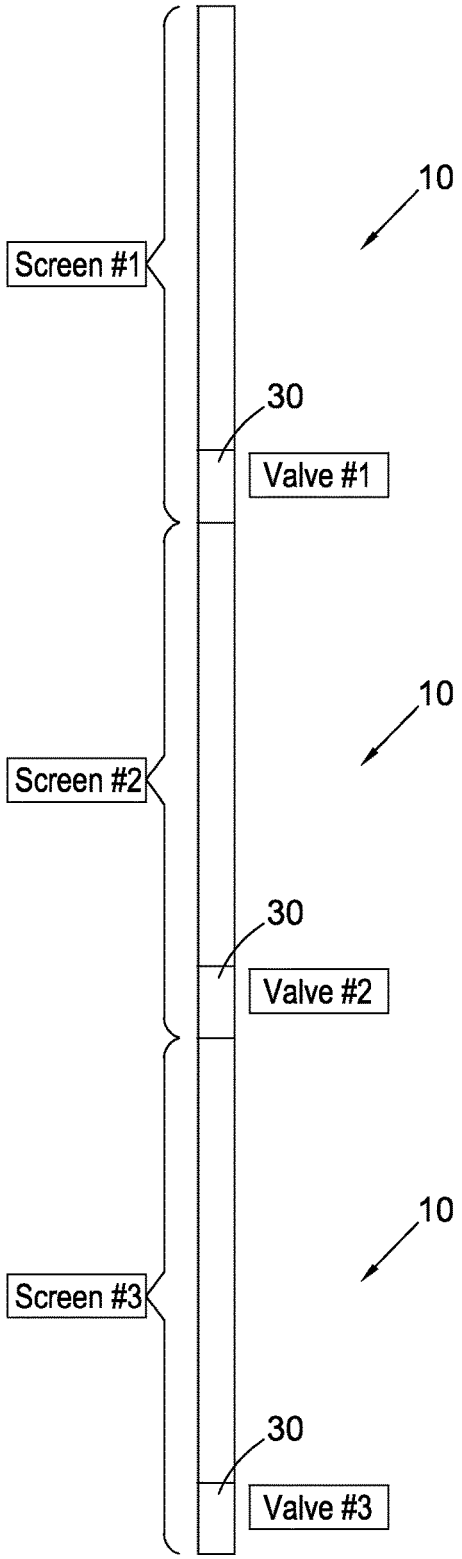
FIG. 6 is a schematic illustration of part of a completion including three sand screens.

FIG. 6 is a schematic illustration of part of a well-bore completion, which includes three sand screens 10. Of course, the completion will include many other elements and devices not shown in the drawing, such as a shoe on the leading end of the completion, packers for zonal isolation, hangers, valves and the like. Typically, a completion will incorporate more than three screens, the number of screens being selected as appropriate.

As will be described in further detail below, the screens 10 are run into the hole in a retracted or smaller diameter configuration and subsequently activated to assume a larger diameter configuration, in which the outer surface of the screens engages the bore wall, whether this be formed by casing, liner, or an unlined bore section, or whether abutting an intermediate apparatus.

Figure 7:
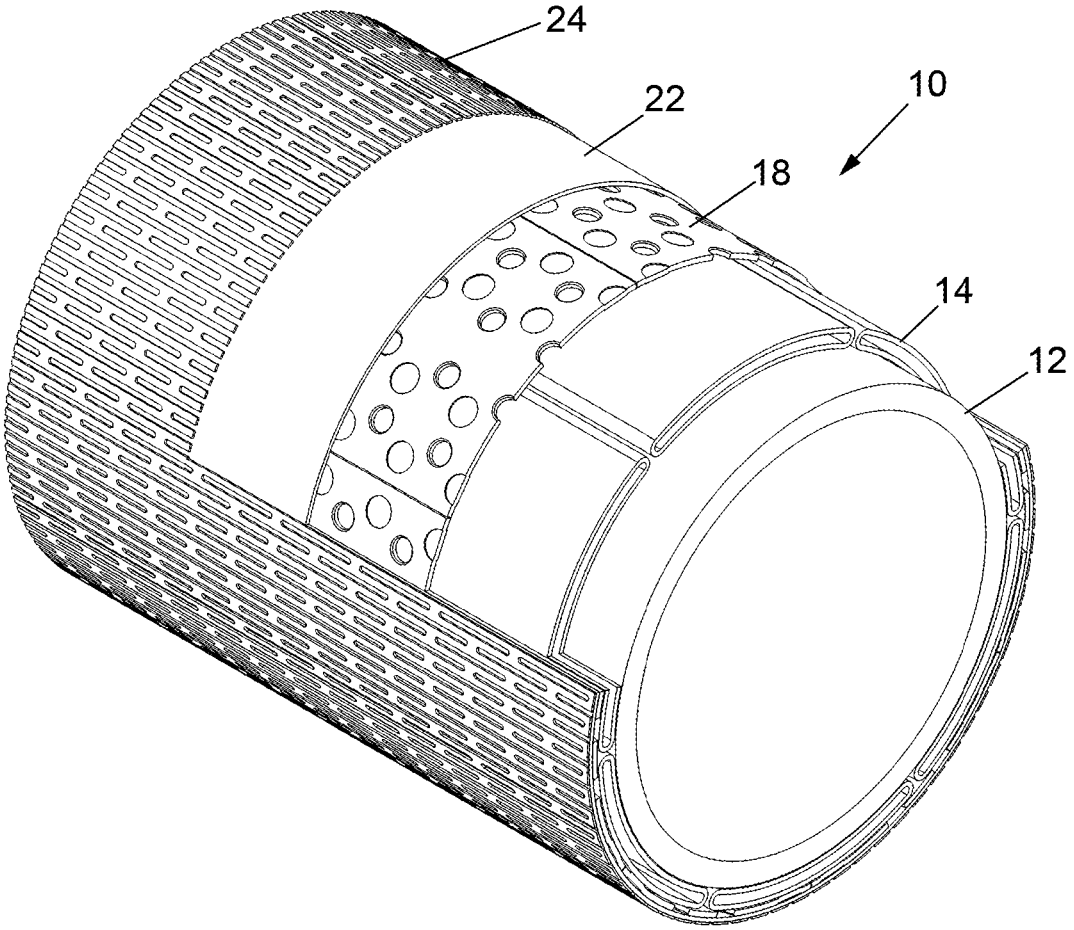
FIG. 7 is a part cut-away view of part of one of the screens of FIG. 6.
Figure 8:
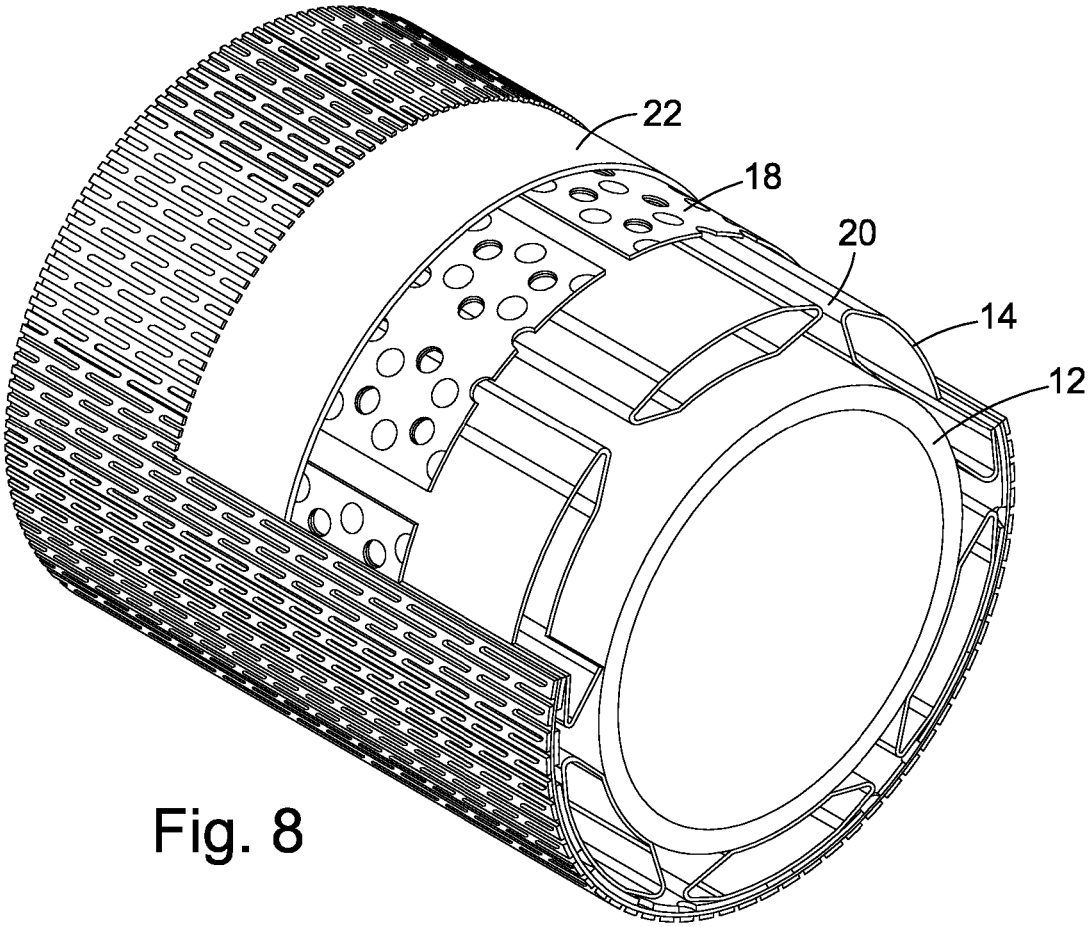
FIG. 8 corresponds to FIG. 7 but shows the screen in an activated configuration.

FIG. 7 of the drawings illustrates a part cutaway view of part of one of the screens of FIG. 6, showing the screen 10 in an initial configuration. The screen 10 includes a base pipe 12 providing mounting for six activation chambers 14 which extend axially along the outer surface of the base pipe 12. The chambers 14 are arranged side-by-side around the base pipe 12 and, as will be described, may be inflated or deformed by filling the chambers 14 with high pressure fluid such that the chambers 14 assume an activated configuration as illustrated in FIG. 8 of the drawings, as so can be used to apply an exertive force.

A drainage layer is located externally of the chambers 14, the layer including six strips 18 of apertured steel sheet. Like the chambers 14, the strips 18 are arranged side-by-side and extend axially along the screen 10, but are circumferentially offset relative to the chambers 14, as illustrated in the drawings, such that when the chambers 14 are extended the strips 18 bridge the gaps 20 formed between the chambers 14. Further detail relating to the drainage layer will be provided below.

The drainage layer supports a filter media in the form of a weave 22, the weave form being selected such that the aperture size of the weave 22 does not vary as the weave 22 is extended to accommodate the deformation of the activation chambers 14. The weave 22 may include a single length of material wrapped around the drainage layer with the longitudinal edges overlapping, or may include two or more lengths or strips of material. A protective shroud 24 is provided over the weave 22.

Reference is now also made to FIGS. 9, 10, 11 and 12 of the drawings, which are sectional view of a valve arrangement 30 of one of the screens 10 of FIG. 6, showing the valve arrangement in first, second, third and fourth configurations respectively. In use, a valve arrangement 30 will be provided at the lower end of each screen 10 between the lower end of the activation chambers 14 and a stub acme connection 32 and a premium connection (not shown) at the end of the screen 10. It will be noted that FIGS. 9, 10, 11 and 12 omit the drainage layer 16, weave 22 and shroud 24.

The valve arrangement 30 includes a body 34 including a number of inter-connected cylindrical portions 34*a*, 34*b* which also form the lower end of the screen body. As will be described, the valve arrangement 30 also includes a number of generally cylindrical internal parts which are configurable to control passage of fluid through first and second ports 36, 38 in the body portion 34*a*. The first ports 36 provide communication with the activation chambers 14 via respective chamber blocks 40 which each incorporate a check valve 42 including a ball 44. The ball 44 may be formed of any suitable material, for example PTFE, ceramic, steel, rubber, brass or aluminium. The second ports 38 also extend through the body portion 34*a* and, when open, allow production fluid to flow from the exterior of the screen 10 into the base pipe 12, and subsequently to surface.

Figure 9:
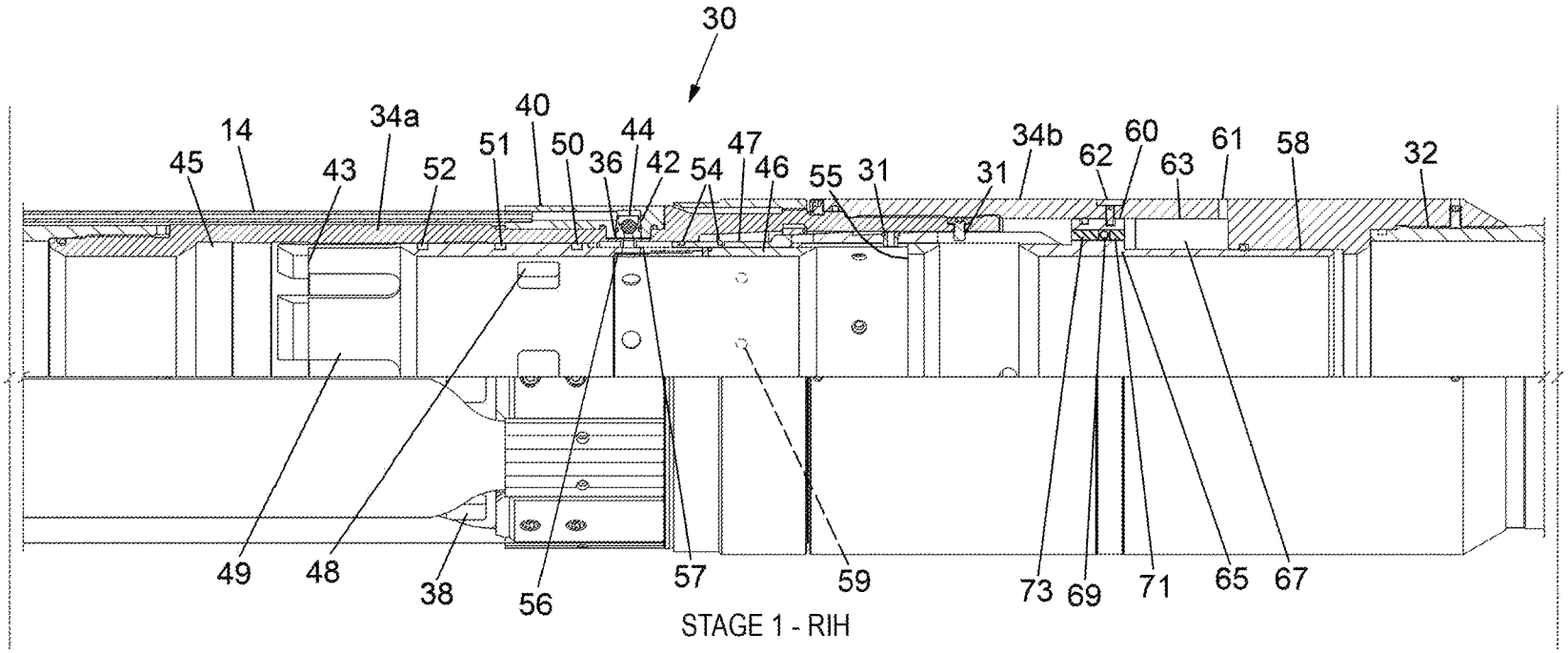
FIGS. 9, 10, 11 and 12 are sectional views of a valve arrangement of one of the screens of FIG. 6, showing the valve arrangement in first, second, third and fourth configurations, respectively.
Figure 9A:
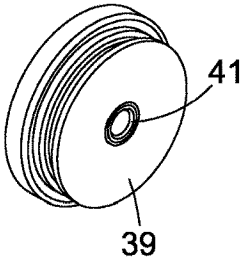
FIGS. 9*a* and 9*b* are views of an ICD insert assembly.
Figure 9B:
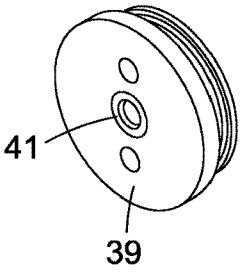

The second ports 38 may be dimensioned or otherwise configured to provide a predetermined pressure drop in production fluid flowing into the base pipe. Thus, over the length of the completion the operator may configure the second ports to provide a desired flow profile taking account of local formation conditions. In one embodiment each second port 38 is provided with an inflow control device (ICD) assembly in the form of a disc 39 for location in the port 38, the disc having a central flow port accommodating an appropriately sized tungsten carbide insert 41, as illustrated in FIGS. 9*a* and 9*b* of the drawings (the skilled person will note that the ports 38 as illustrated in the figures are non-circular, and thus ICDs in the form of discs 39 are intended for use in combination with an alternative embodiment featuring circular second ports). The insert 41 is selected to provide the desired flow area or pressure drop and is pressed into the disc 39, which is then screwed into the port 38 from the outside of the body portion 34*a*, the disc outer face being provided with a screw thread configured to engage with a corresponding screw thread provided on the port 38. The disc 39 is also provided with an O-ring seal. If appropriate, some ports 38 of a valve arrangement 30 may be fitted with a disc including a blank insert, preventing flow through selected ports.

The valve arrangement 30 includes a primary valve sleeve 46. A central part of the sleeve 46 defines production ports 48 which, when the valve arrangement 30 is in the third configuration, are aligned with the second ports 38. In the first configuration, as illustrated in FIG. 9, the production ports 48 are offset from the second ports 38, and isolated from the exterior of the valve sleeve 46 by seals 50, 51. A further seal 52 also serves to isolate the second port 38. The lower part of the valve sleeve 46 defines an internal profile 55 for engaging an intervention tool, as will be described. The upper end of the sleeve 46 includes collet fingers 49 which have outer profiles for engaging with locating recesses 45 formed in the inner diameter of the body 34. The collet fingers 49 also define profiles 43 which allow for mechanical engagement with an intervention tool if required, as will be described.

Figure 11:
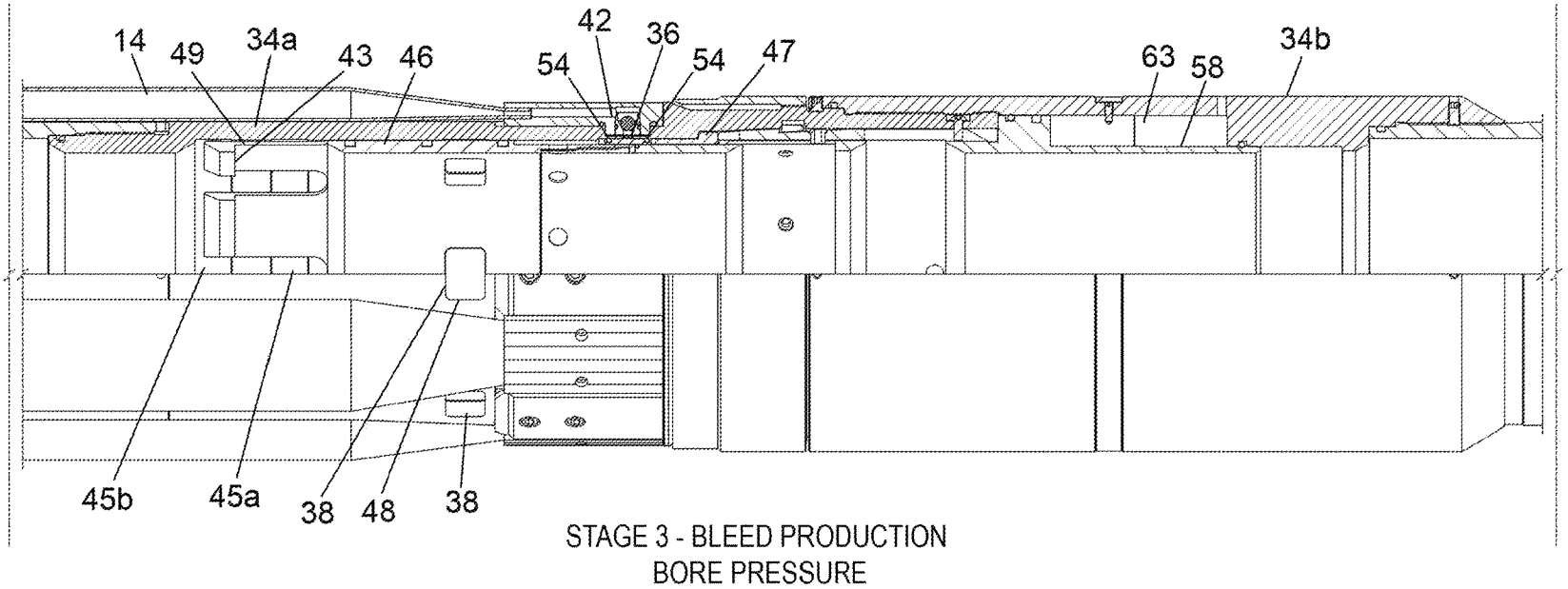
Figure 12:
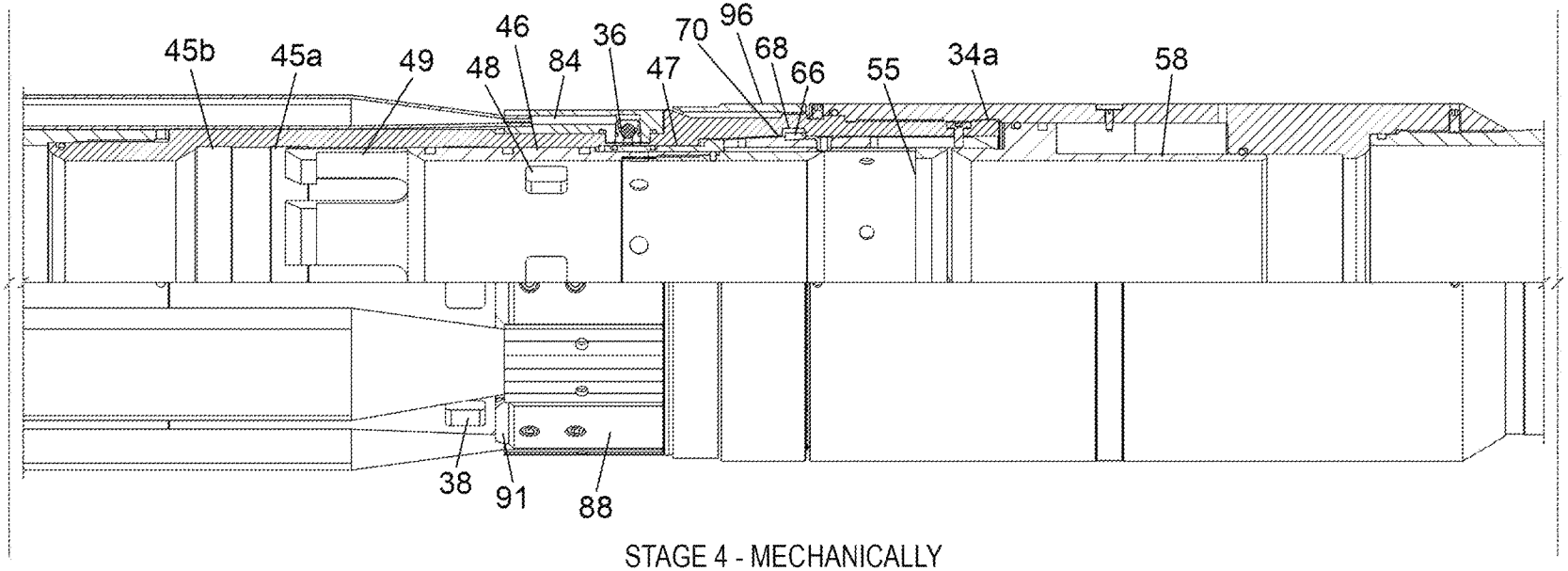

A secondary valve or shuttle sleeve 47 is located externally of the primary valve sleeve 46 and carries external seals 54 for isolation of the first port 36 when the valve arrangement is in the third and fourth configurations, as illustrated in FIGS. 11 and 12. The sleeves 46, 47 are initially fixed together by shear pins 59. In the first and second configurations the shuttle sleeve 47 is located downwards and clear of the first ports 36, and activation ports 56 in the primary valve sleeve 46, which may include a filter member 57, are aligned with the first ports 36, providing for fluid communication between the interior of the screen 10 and the activation chambers 14.

Figure 9C:
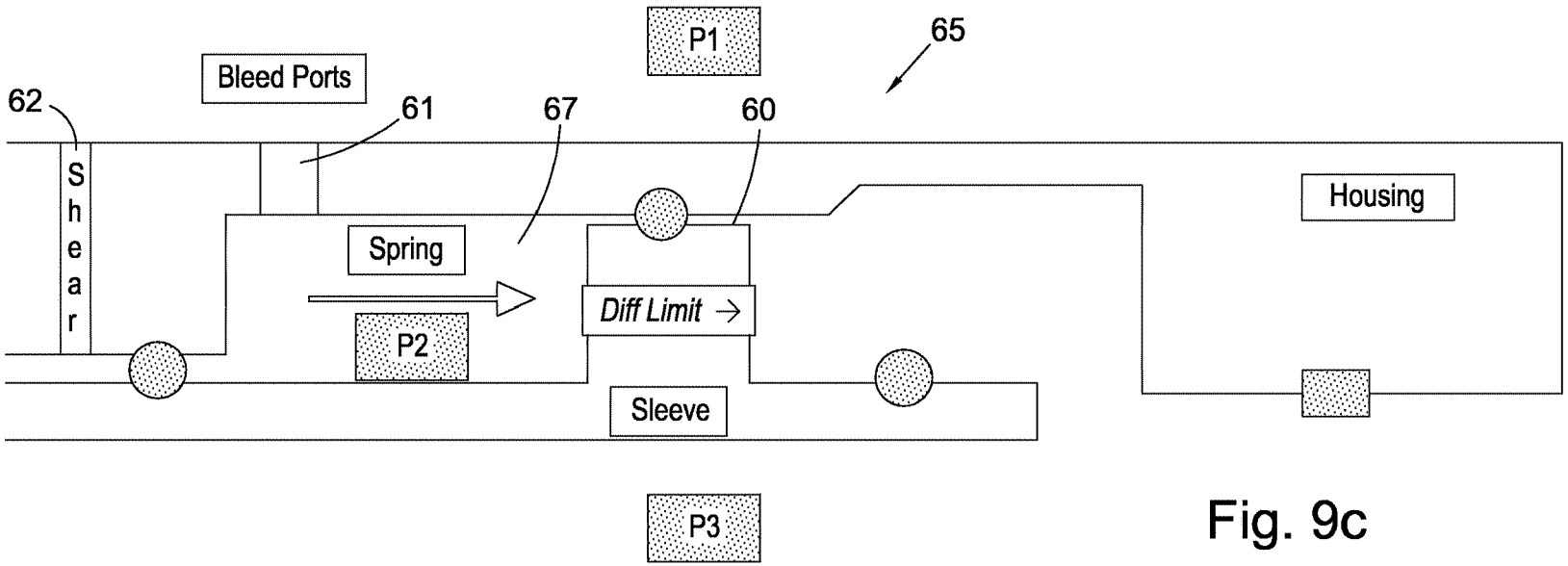
FIG. 9*c* is a schematic of a check valve.
Figure 10:
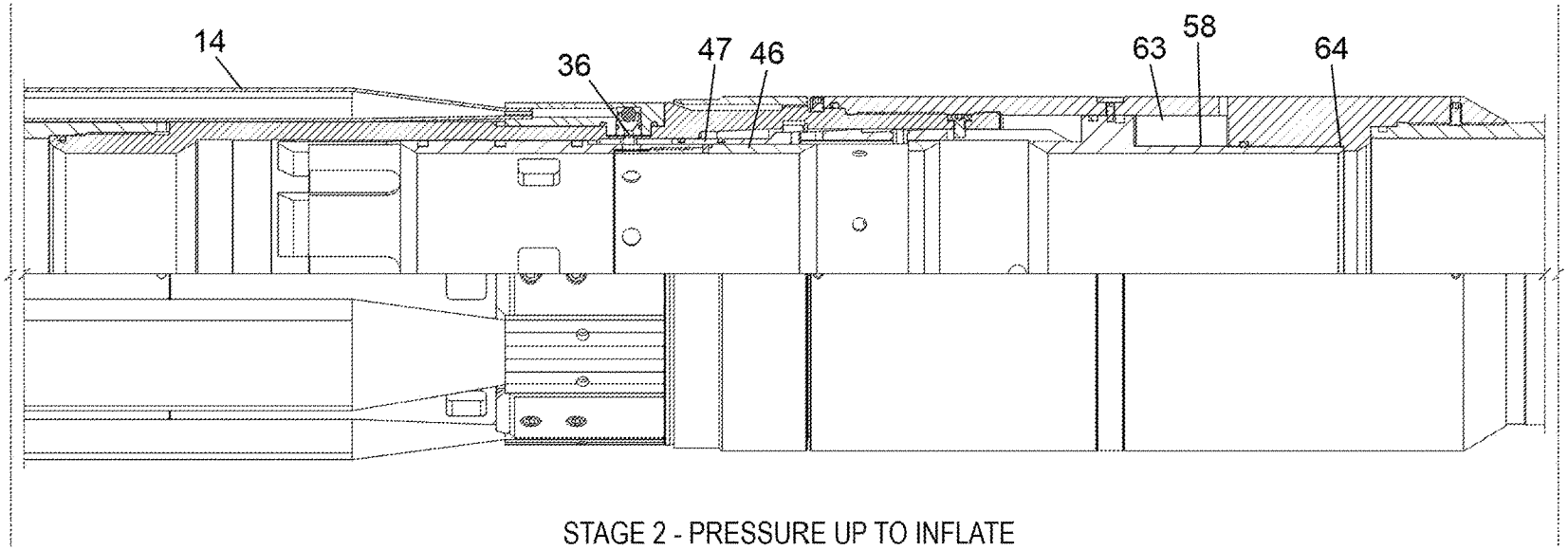

A valve actuating sleeve 58 is also located within the body 34 and features an external shoulder 60 which provides a sealing contact with the body portion 34*b*. Shear pins 62 initially lock the sleeve 58 relative to the sleeve body against the action of a compression spring 63 contained in a chamber 67 between the sleeve 58 and the body portion 34*b*. While the upper face of the shoulder 60 is exposed to internal or pipe pressure, the lower face of the shoulder 60 is exposed to external or annulus pressure via a port 61 in the sleeve body, such that the shoulder 60 acts as a differential piston. To prevent accidental unlocking of the sleeve 58 due to reverse differential pressure, for example an rise in annulus pressure relative to internal pressure, check valves 65 (one shown) extend through the shoulder 60, allowing fluid to bleed from the chamber between the sleeve 58 and the body portion 34*b* and into the valve, thus relieving any excess reverse pressure. A schematic of a check valve 65 is shown in FIG. 9*c* of the drawings. Accordingly if, for example, during installation or retrieval of the completion, fluid is being circulated down through the completion and up the surrounding annulus, there may be circumstances in which the annulus pressure (P1) rises above the internal pressure (P3). In this situation, fluid from the annulus may bleed through the port 61 and into the spring chamber 67, undergoing a pressure drop to a lower pressure (P2) in the process. This reduces the pressure differential across the shoulder 60. However, if sufficient, the remaining pressure differential between the chamber 67 and the interior of the completion may then lift the check valve ball 69 off its seat 71, against the action of a spring 73, allowing the fluid to bleed from the chamber 67 and into the completion. Thus, an operator may employ relatively high circulation rates, safe in the knowledge that a higher pressure in the annulus will not result in premature shearing of the pins 62, and premature release of the sleeves 58, 46, 47. The number and configuration of check valves 65 may be selected as appropriate to the completion configuration and anticipated operating conditions. An upper end of the sleeve 58 extends externally of the lower end of the primary valve sleeve 46 and abuts the lower end of the shuttle sleeve 47.

As noted above, in the first configuration the activation ports 56 are aligned with the first ports 36, while the second ports 38 are closed due to the misalignment between the ports 38 and the production ports 48; the screens 10 are run in hole in this configuration. A positive pressure differential between the interior of the screens 10 and the chambers 14 will open the check valve 42 and allow fluid to flow from the interior of the completion into the activation chambers 14, via the chamber blocks 40. Thus, in use, when the completion is pressurized up to a first pressure, the chambers 14 will undergo an initial degree of inflation or deformation with the valve arrangement 30 in this first configuration. The pipe pressure may be held at this first pressure for a period to provide an initial degree of inflation of the chambers 14. Of course, rather than pressurising the entire completion, an operator may run a wash pipe or the like inside the completion to communicate pressure from surface to the screens 10.

After a predetermined interval the internal pipe pressure may be increased to a higher second level to bring the differential pressure experienced across the shoulder 60 to a level sufficient level to shear the pins 62, as illustrated in FIG. 4*c*. This pressure differential causes the check valve balls 69 to seat, ensuring the check valves 65 remain closed. This results in a small downward movement of the sleeve 58, against the action of the spring 63, until the lower end of the sleeve 58 engages a stop 64. However, this movement is not transferred to the primary valve sleeve 46, or the shuttle sleeve 47. Thus, the first port 36 remains open while the higher second pressure fully inflates and activates the chambers 14.

After a further predetermined interval, following which the operator may be confident that all of the screens 10 have been fully activated, pressure may be bled off from the completion, allowing the spring 63 to move the sleeve 58 upwards relative to the body 34, as illustrated in FIG. 11. After an initial degree of movement, this movement of the sleeve 58 is also translated to the valve sleeves 46, 47, moving the sleeves 46, 47 upwards to close the first ports 36 and open the second ports 38, in particular aligning the ports 38 with the production ports 48 in the sleeve 46. This requires the collet fingers 49 to be dislodged from the lower recess 45*a* and moved to engage with the upper recess 45*b*. Furthermore, alignment of the ports 38, 48 is ensured by the provision of timing pins 31, which prevent relative rotation of the body portion 34*a* and sleeves 46, 47.

In this third valve configuration high pressure fluid is locked in the inflated chambers 14 by the check valves 42 and the shuttle sleeve 47, while production fluid may flow into the screen through the aligned ports 38, 48.

If any of the valve sleeves 46, 47 do not move to the third configuration when pressure is bled off, and intervention tool may be employed to engage the collet profile 43 and mechanically shift the sleeves 46, 47 upwards. In addition, if at any point in the future an operator wishes to shut off production from a particular screen 10, a mechanical intervention tool may be run into the bore to engage the sleeve profile 55. The primary valve sleeve 46 may thus be pushed downwards, dislodging the collet fingers 49 from the upper recess 45*b* to the lower recess 45*a*, such that the ports 38, 48 are moved out of alignment, as illustrated in FIG. 12 of the drawings. However, a split ring 66 located in a recess 68 in the body portion 34*a* engages with an external shoulder 70 on the upper end of the actuating sleeve 58 preventing downward movement of the sleeve 58 and also locking the shuttle sleeve 47 in the port-closing position; if sufficient force is applied by the intervention tool the connecting shear pins 59 between the sleeves 46, 47 will fail, allowing relative movement of the sleeves 46, 47, such that the first port 36 remains isolated.

Figure 13:
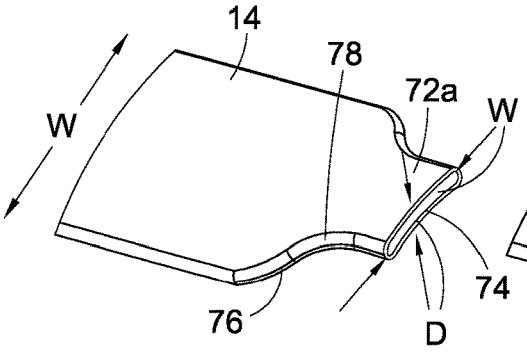
FIGS. 13 and 14 are views of ends of activation chambers of one of the sand screens of FIG. 6.
Figure 14:
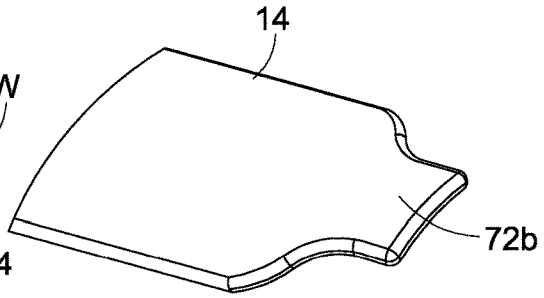
Figure 15:
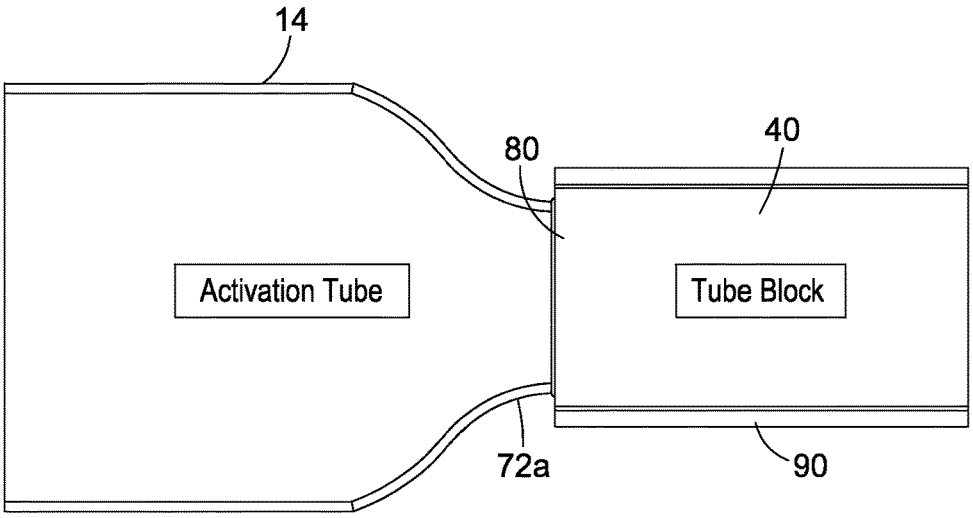
FIGS. 15 and 16 are views of activation chambers and chamber blocks of one of the sand screens of FIG. 6.
Figure 16:
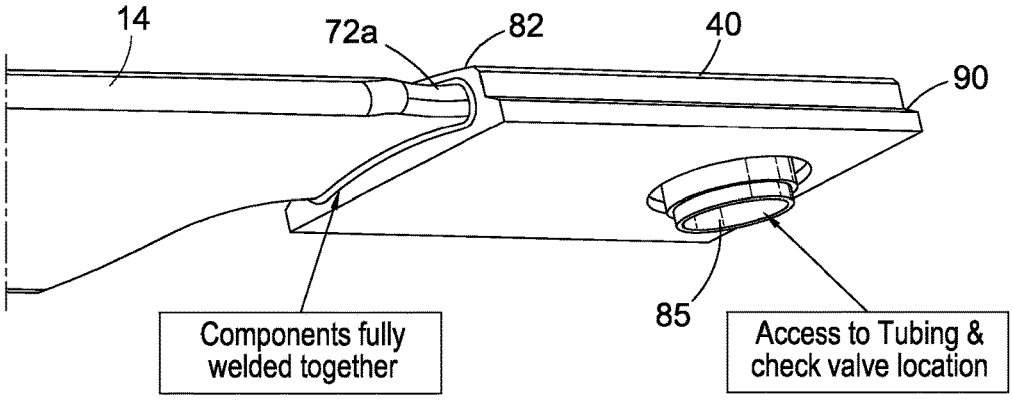

Reference is now made to FIGS. 13, 14, 15 and 16 of the drawings, which illustrate details of the activation chambers 14 and the chamber blocks 40. In particular, FIG. 13 shows the lower end of an activation chamber 14, while FIG. 14 shows the upper end of an activation chamber 14. The activation chambers 14 are elongate and have a width W and depth D. In one embodiment, the chambers 14 are formed by folding a long narrow sheet of metal in a series of steps to provide the desire profile, the meeting edges then being joined by a suitable method, for example being laser or high frequency welded. However, both ends of the chambers are cut away to provide a narrow tab or spigot 72. The cut metal edges which define the lower spigot 72*a* are welded to leave an opening for passage of fluid, while the upper spigot 72*b* is welded closed. Thus, the opening 74 on the lower spigot 72*a* is of a width w, less than the chamber width W. Also, the edges defining the transition from the full width chamber to the spigots 72 are radiused, in particular being formed with an outer radius 76 and an inner radius 78. On inflation or deformation of the chambers 14, the outer radius 76 reduces the stresses at the end of the chambers 14, reduces the shrinkage in length during activation, reduces the potential for damaging the weave 22, and smoothes out the end profile of the deformed chamber 14. The inner radius 78 reduces stresses in the transition area during activation.

The open spigot 72*a* allows for fluid communication between the activation chamber 14 and the interior of the completion, via the chamber block 40 which includes an opening 80 in an end face to receive the spigot 72*a*. The spigot 72*a* and chamber block 40 are assembled while separated from the screen body, and the components are then bonded together around the complete perimeter of the opening 80 to provide pressure integrity, the bond 82 being perhaps most clearly visible in FIG. 16 of the drawings. The bond 82 may be provided by any suitable method, typically welding, for example TIG, laser or robotic welding.

Within the chamber block 40 there is a drilled hole 84 (FIG. 12), which extends to intercept a radial recess 85 which accommodates the check valve 42.

The closed spigot 72*b* is restrained by an alternative clamp body (not shown). The upper end of the chambers 14 may be fixed to the respective upper clamp body or be mounted to permit a degree of axial movement, for example to allow for axial shrinkage of the chamber 14 on inflation. In other embodiments the spigot 72*b* may be provided with a relief valve to protect against over-pressurisation of the chambers 14, or may provide fluid communication with other activating chambers in the same or an adjacent assembly.

The chamber blocks 40 are retained in place on the screen body 34*a* by clamps 88 (FIG. 12) which are bolted to the body 34*a* and engage with shoulders 90 formed on the edges of the blocks 40.

Figure 17A:
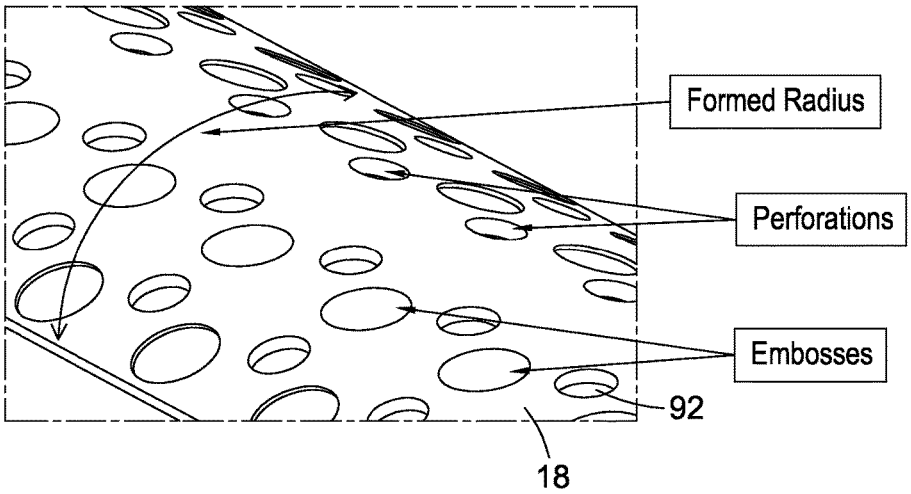
FIGS. 17*a* and 17*b* are views of elements of a drainage layer of one of the sand screens of FIG. 6.
Figure 17B:
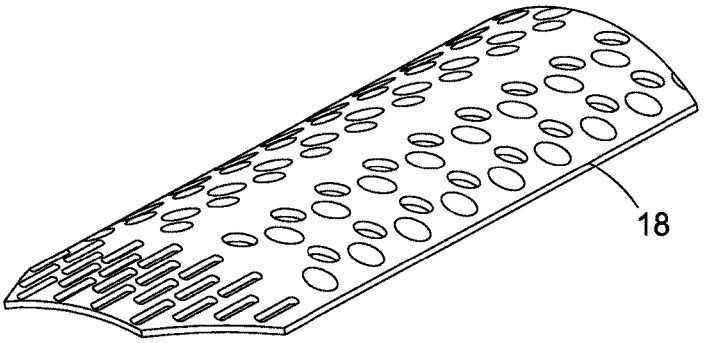

As noted above, drainage strips 18 are mounted externally of the mounted chambers 14, and parts of a drainage layer strip 18 are illustrated in FIGS. 17*a* and 17*b* of the drawings. In use, the drainage layer formed by the strips 18 lifts the weave 22 from the activating chambers 14, maximizing inflow through and around the screen. The strips 18 are of solid steel plate provided with perforations 92 which allow oil or gas to flow through weave 22 and into the screen 10. The strips are produced by punching and embossing flat plate to provide the required pattern, before roll forming to the required radius and then cutting to length. The perforations 92 may be any appropriate shape or size, and in the illustrated embodiment each strip 18 includes four axial rows of round holes. As noted above, the strips 18 are also embossed to form protrusions on the inner surface of the strips 18, to lift the drainage layer up from the activation chambers 14 to permit flow under the layer and between the activating chambers 14 and the strips 18. Again, the embosses 94 may be any appropriate shape, size or depth, and in the illustrated embodiment the embosses 94 are formed as four axial rows, axially and circumferentially offset from the perforations 92. The strips 18 are formed with an inner radius to match the outer radius of the activation chambers 14 to ensure that the outer diameter of the screen 10 is minimised and that the drainage layer formed by the strips 18 provides optimum support across the activation chambers 14.

The ends of the strips 18 are tapered and are secured on the screen 10 by welding to shoulders 91 (FIG. 12) provided on the chamber block clamps 88. The strip ends are also slotted to facilitate deformation; the strip ends must bend and extend to accommodate the activation of the chambers 14.

Following activation and deformation of the chambers 14 the drainage layer strips 18 provide support to the weave 22 as the gaps 20 (FIG. 8) between the activation chambers 14 increases. Also, the radiused strips 18 assist in maintaining a substantially circular shape during the activation process. In the absence of such support, the screen would assume a hexagonal shape due to the weave 22 and the outer shroud 24 forming straight lines between each activation chamber outer diameter.

Figure 18:
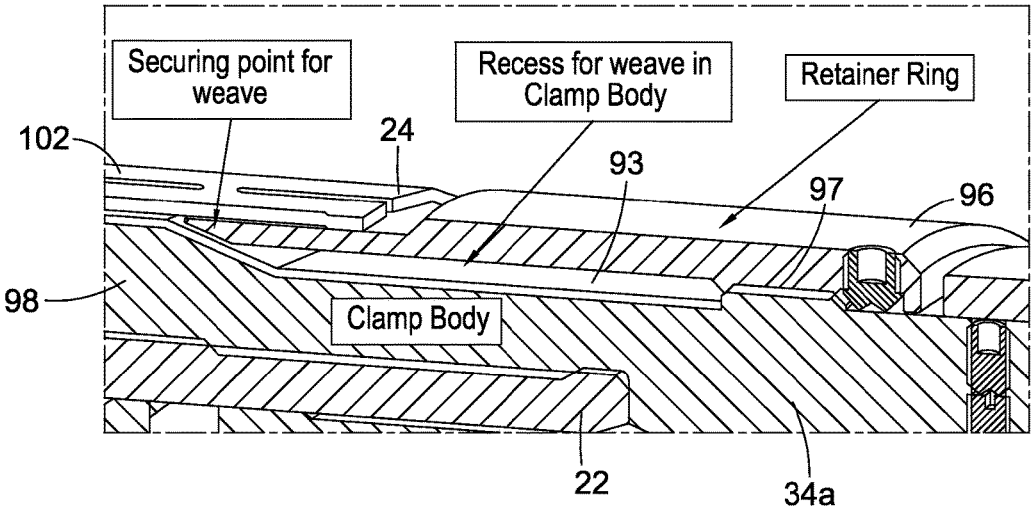
FIG. 18 is a sectional view of a clamp arrangement of one of the sand screens of FIG. 6.

Reference is now also made to FIG. 18 of the drawings, which illustrates a clamp arrangement for use in securing the weave 22 in place on the screen 10. The Figure shows the body portion 34*a* which serves as a clamp body and a retainer ring 96 which may be threaded to the body 34*a*. The clamp body 34*a* defines a recess 93 upwards of the thread 97, and a tapering surface 98 leading down into the recess 100. The ring 96 includes a corresponding tapering surface 102 on its upper end, such that when the ring 96 is tightened on the body 34*a* the surfaces 98, 102 come together and clamp a portion of the weave 22 therebetween.

During the fabrication process, the weave 22 is wrapped around the screen body, over the drainage layer formed by the strips 18, with the upper and lower ends of the weave 22 positioned in the recesses 93 (a similar clamping arrangement is provided at the upper end of the screen).

The weave 22 may be held in place using rachet straps, spot welding or the like, and if desired the weave 22 may be spot welded in the recess 93. Spot welds may also be provided along the length of the screen 10, to secure the weave 22 to the strips 18. The clamping ring 96 is then screwed on to the clamp body 34*a* and the taper surfaces 98, 102 clamp and secure the weave 22. The shroud 24 is then located over the clamped weave 22.

Figure 19:
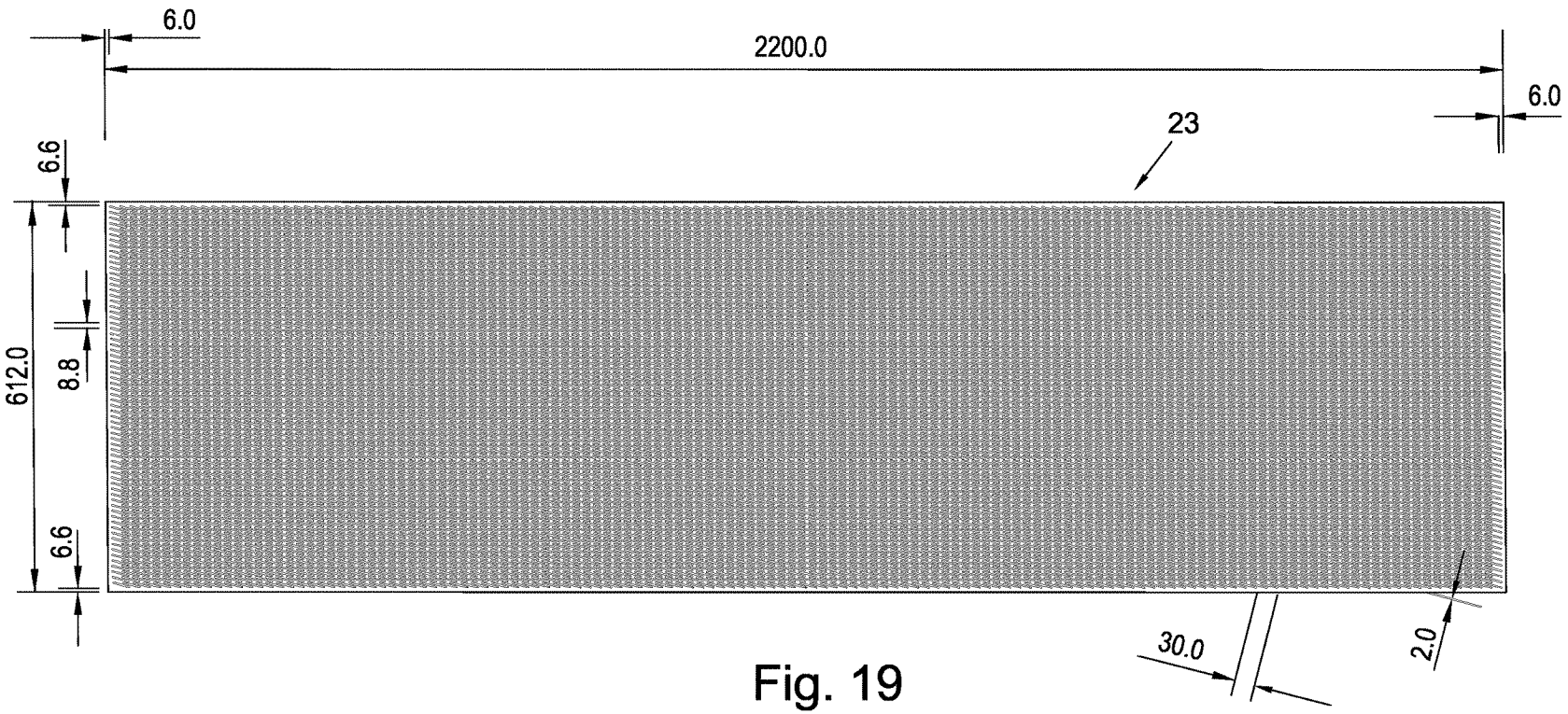
FIG. 19 is a plan view of a sheet to be formed into a sand screen shroud.
Figure 20:
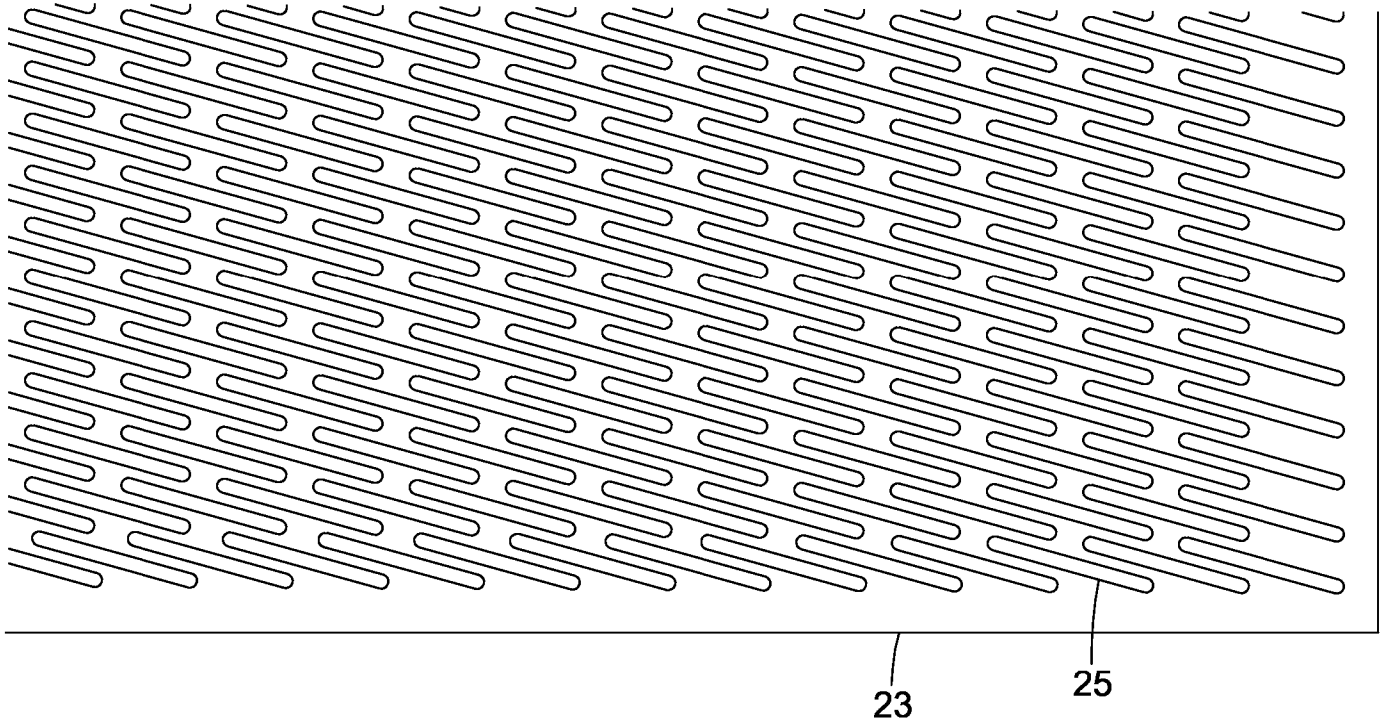
FIG. 20 is an enlarged view of a portion of the sheet of FIG. 19.

Reference is now made to FIGS. 19 and 20 of the drawings, which illustrate details of the apertured sheet or plate 23 utilised to form the shroud 24. Conventional shrouds are formed with elongate longitudinally extending overlapping slots, and on expansion of the sand screen the slots open to accommodate the increase in the circumference described by the shroud; the shroud is intended to provide a degree of protection for the weave but is intended to be readily extendable such that the expansion of the weave is not restricted. The screen 10 may be provided with such a conventional shroud. However, the shroud 24 of the illustrated embodiment of the present invention features 30 mm long slots 25 which are inclined at 15 degrees along the plate length. This results in a shroud 24 which will require greater pressure to expand, thus providing greater control of the activation pressure required to initiate expansion of the screen 10. The angled slots 25 also result in less friction between the outer surface of the weave 22 and the inner surface of the shroud 24 as the slots 25 open and the weave 22 slides underneath the shroud 24.

Figure 21:
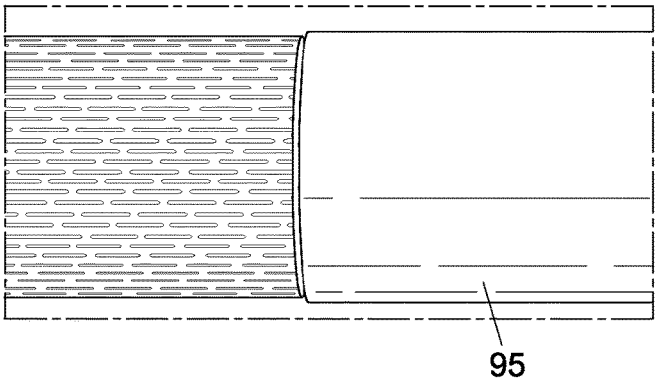
FIGS. 21 and 22 are views of a sand screen in accordance with a further embodiment.
Figure 22:
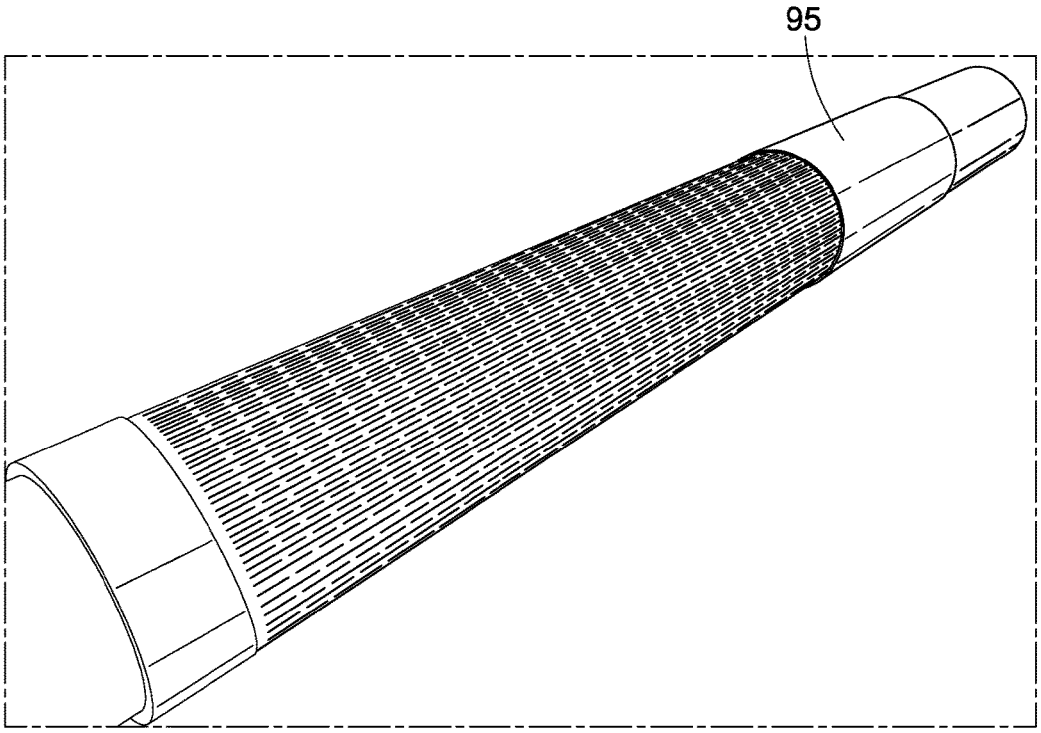
Figure 23:
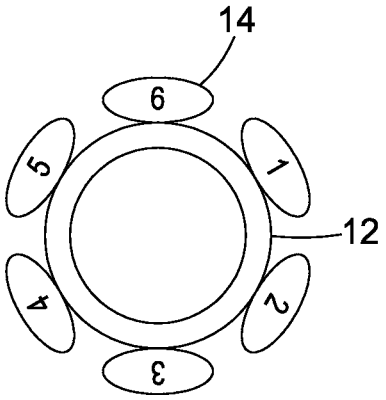
FIGS. 23, 24, 25 and 26 are schematic sectional views of structures in accordance with further embodiments.

For most applications it is envisaged that the shroud 24 will form the outer surface of the screen. However, in some embodiments a portion of the screen may be covered with an elastomer, as illustrated in FIGS. 21 and 22 of the drawings. In this embodiment a neoprene elastomer coating 104 has been wrapped around a portion of the screen outside diameter. Once such a screen has been activated, the rubber coating 104 will be pushed out against the surrounding casing or formation and will provide a restriction or baffle to the flow of production fluids between zones; the coating 104 may provide a low pressure seal or a restriction to flow of fluid past the screen, but may permit fluid to flow beneath the coating 104 and into or along the screen. Of course in other embodiments different qualities of material may be utilised to provide a higher pressure seal.

Reference is now made to FIGS. 23, 24, 25 and 26 of the drawings which are schematic sectional view of structures in accordance with various further embodiments. In the screens described above, and as illustrated in FIG. 23, activation chambers 14 are arranged around a circular base pipe 12. Testing has demonstrated that the provision of inflated activation chambers 14 on the outside diameter of the base pipe 12 contained within a bore creates a structure with significantly enhanced crush resistance when compared to a structure consisting essentially of a base pipe 12 alone. It is believed this is due, at least in part, to the cushioning effect of the activation chambers 14, compression of an inflated activation chamber 14 by an externally applied mechanical load leading to an increase in internal fluid pressure which results in the load being spread along the length of the chamber 14 and radially around the screen. Also, when such a structure is subject to a high load on one side of the structure the pressure increases in the chambers on the other side of the structure: for example, if a high load is applied in the region of the chamber 14(6), an elevated pressure is measured in the opposite chamber 14(3), and to a lesser extent in adjacent chambers 14(4) and 14(2). Testing has further demonstrated that the chambers 14 tend to absorb at least initial deformation of the structure, such that the internal diameter of the base pipe 12 remains substantially unobstructed. Also, the deformed chambers 14 tend to recover, typically by around 50%, when the applied force is reduced.

Testing also identified that the sand integrity of sand screens incorporating inflated chambers 14 as described herein when subject to crush or pinch loads was maintained at very high loading, as was the integrity of the chambers 14. In one test the pressure in the chambers 14 increased from an initial 1000 psi to almost 1200 psi, corresponding to a 1 inch deformation of a sand screen with an activated outer diameter of 8½ inches. Thus, a sand screen in accordance with an embodiment of the present invention will withstand significant crush loading, for example from a swelling or partially collapsing formation, and will accommodate a degree of deformation without adversely affecting the base pipe 12. Of course this effect is not limited to sand screen, and inflatable chambers may be mounted on an impervious section of a completion intended to intersect a non-producing problem formation. Accordingly, an operator may be able to utilise significantly lighter and less expensive base pipe 12, and may be able to drill and then maintain bores through difficult formations, for example swelling formations which would otherwise be expected to crush bore lining tubing located in the bores.

Figure 24:
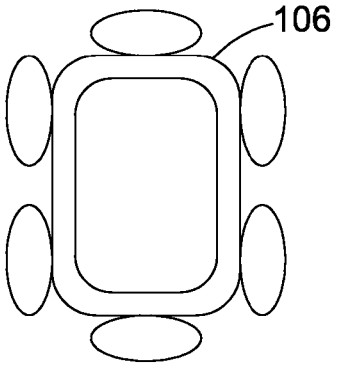
Figure 25:
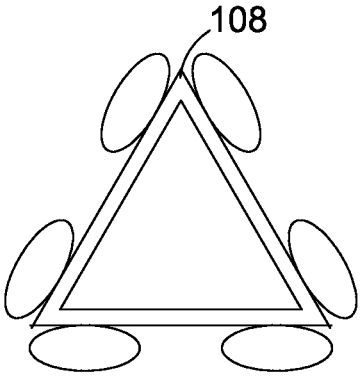
Figure 26:
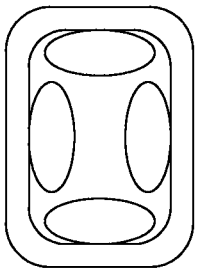

FIGS. 24, 25 and 26 illustrate that this principle may be employed to increase the collapse and crush resistance of other tubular forms, such as the rectangular and triangular base pipes 106, 108 of FIGS. 24 and 25, and also in providing protection against internal loads as illustrated in FIG. 26.

As has been described, near-wellbore formation 140 problems, such as reduction in permeability and mobilisation have been addressed, by applying an exertive force to the near wellbore formation 140 and, additionally, using an appropriate drawdown pressure, based on the exertive force. Such an exertive force essentially re-stresses the formation 140 at the wellbore wall 105. This process prevents solids from re-sorting and thus maintains formation permeability. As will be appreciated, the process and apparatus can be effectively use for sand control at a wellbore, for example, using an exertive force together with a drawdown pressure in order to inhibit, reduce or mitigate sand mobilisation at a wellbore, or even in some cases increase sand mobilisation.

This method and apparatus allows for greater drawdowns to be placed on a reservoir 130 and can increase productivity.

It will be appreciated that, while in the above example, production from a subterranean formation, as a reservoir, has been described illustratively, in further embodiments the same apparatus and methods may be used to select or apply a particular exertive force to a wellbore in addition to a particular drawdown pressure in order to operate injections at any subterranean formation.

In other words, in some examples, the same method and/or apparatus can be used to inject to a subterranean formation (without necessarily being a reservoir), and modifying the formation in order to assist with that injection. In such further embodiments, the drawdown pressure may be considered to be a negative drawdown pressure (or so-called injection pressure), causing fluid to flow from the wellbore to the formation. A skilled reader would readily be able to implement those embodiments accordingly. In some example, the same methods and apparatus may be used to produce and inject at a particular wellbore.

Various embodiments are described herein with reference to block diagrams or flowchart illustrations of computer-implemented methods, apparatus (systems and/or devices) and/or computer program products. It is understood that a block of the block diagrams and/or flowchart illustrations, and combinations of blocks in the block diagrams and/or flowchart illustrations, can be implemented by computer program instructions that are performed by one or more computer circuits. These computer program instructions may be provided to a processor circuit of a general purpose computer circuit, special purpose computer circuit, and/or other programmable data processing circuit to produce a machine, such that the instructions, which execute via the processor of the computer and/or other programmable data processing apparatus, transform and control transistors, values stored in memory locations, and other hardware components within such circuitry to implement the functions/acts specified in the block diagrams and/or flowchart block or blocks, and thereby create means (functionality) and/or structure for implementing the functions/acts specified in the block diagrams and/or flowchart block(s).

These computer program instructions may also be stored in a computer-readable medium that can direct a computer or other programmable data processing apparatus to function in a particular manner, such that the instructions stored in the computer-readable medium produce an article of manufacture including instructions which implement the functions/acts specified in the block diagrams and/or flowchart block or blocks.

A tangible, non-transitory computer-readable medium may include an electronic, magnetic, optical, electromagnetic, or semiconductor data storage system, apparatus, or device. More specific examples of the computer-readable medium would include the following: a portable computer diskette, a random access memory (RAM) circuit, a read-only memory (ROM) circuit, an erasable programmable read-only memory (EPROM or Flash memory) circuit, a portable compact disc read-only memory (CD-ROM), and a portable digital video disc read-only memory (DVD/Blu-ray).

The computer program instructions may also be loaded onto a computer and/or other programmable data processing apparatus to cause a series of operational steps to be performed on the computer and/or other programmable apparatus to produce a computer-implemented process such that the instructions which execute on the computer or other programmable apparatus provide steps for implementing the functions/acts specified in the block diagrams and/or flowchart block or blocks.

Accordingly, the invention may be embodied in hardware and/or in software (including firmware, resident software, micro-code, etc.) that runs on a processor, which may collectively be referred to as "circuitry," "a module" or variants thereof.

It should also be noted that in some alternate implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved. Moreover, the functionality of a given block of the flowcharts and/or block diagrams may be separated into multiple blocks and/or the functionality of two or more blocks of the flowcharts and/or block diagrams may be at least partially integrated. Finally, other blocks may be added/inserted between the blocks that are illustrated.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the invention may consist of any such individual feature or combination of features. In view of the foregoing description it will be evident to a person skilled in the art that various modifications may be made within the scope of the invention.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

The invention claimed is:

1. A method comprising the steps of:

determining a combination of a drawdown pressure at a wellbore and an exertive force to apply at the wellbore that a provide a particular permeability of a near wellbore formation in the wellbore;

selecting the drawdown pressure of the determined combination to modify operations at a subterranean formation; and selecting the exertive force of the determined combination;

a selection of one or both of the exertive force and the drawdown pressure being based on a downhole environment at the wellbore;

applying the exertive force together with the drawdown pressure at the wellbore to modify operations at a subterranean formation;

applying a first pressure through a base pipe, prior to applying the exertive force, to a fluid pressure-responsive valve arrangement to provide fluid communication with an activation chamber arranged at the subterranean formation;

applying a second pressure, different than the first pressure, through the base pipe, to the fluid pressure-responsive valve arrangement to activate the activation chamber to apply the exertive force; and applying a third pressure through the base pipe, while applying the exertive force, the third pressure force lower than the second pressure to the fluid pressure-responsive valve arrangement to thereby move a closure member of the valve arrangement under the bias of a biasing mechanism to position the closure member to both prohibit fluid communication between the base pipe and activation chamber, and also establish fluid communication from the subterranean formation to the base pipe through the valve arrangement;

wherein movement of the closure member under the bias of a biasing mechanism includes moving a sliding sleeve with a spring to cover at least one first port in fluid communication with the activation chamber to thereby prohibit fluid communication between the base pipe and activation chamber and additionally to uncover at least one second port in fluid communication with an exterior of the base pipe to thereby establish fluid communication from the subterranean formation to the base pipe through the valve arrangement.

2. The method according to claim 1, wherein one of the exertive force and the drawdown pressure is constrained such that selecting both the exertive force together with the drawdown pressure is based on using the constrained exertive force or the constrained drawdown pressure.

3. The method according to claim 1, further comprising the step of selecting a hydrostatic pressure at the wellbore in order to modify operations at the formation.

4. The method according to claim 1, wherein the downhole environment includes a porosity of a near-wellbore formation, the near-wellbore formation being a region of formation radially surrounding the wellbore into the formation.

5. The method according to claim 4, wherein the near-wellbore formation extends up to 1.6 times a diameter of the wellbore into the formation surrounding some or all of the wellbore.

6. The method according to claim 4, wherein the exertive force and the drawdown pressure are selected to increase support and/or strength of the near-wellbore formation.

7. The method according to claim 4, wherein the exertive force and the drawdown pressure are selected to maintain or reduce a rate of change of the porosity and/or permeability of the near-wellbore formation during operations at the subterranean formation.

8. The method according to claim 4, wherein the exertive force is for application from the wellbore to an intermediate apparatus positioned at the wellbore, the exertive force for modification of the intermediate apparatus without being transmitted to the near-wellbore formation.

9. The method according to claim 1, wherein the exertive force is for application from the wellbore to the near-wellbore formation.

10. The method according to claim 1, wherein the exertive force is for application from the wellbore to the near-wellbore formation via an intermediate apparatus positioned at the wellbore.

11. The method according to claim 1, wherein the exertive force is selected to provide or induce a particular stress state, including dilation, in the formation or near-wellbore formation.

12. The method according to claim 1, wherein the exertive force is selected to provide or induce different stress states at differing locations, axially and/or azimuthally in the formation or the near-wellbore formation.

13. The method according to claim 1, wherein the exertive force is provided as a force per unit area of a wall defining the wellbore.

14. The method according to claim 13, wherein the exertive force is selected to apply a similar force per unit area around some or all of the wellbore.

15. The method according to claim 13, wherein the exertive force is selected to provide different forces per unit area around some or all of the wellbore.

16. The method according to claim 1, wherein the selection of one or both of the exertive force and the drawdown pressure is based on an expected stress state during a lifetime of the wellbore.

17. A method according to claim 1, wherein operation of the formation includes modifying, including increasing, production from a reservoir.

18. The method according to claim 1, wherein the drawdown pressure is a negative drawdown pressure for injection at the wellbore, and wherein operation of the formation includes injecting at the formation.

19. The method according to claim 1, wherein the exertive force together with the drawdown pressure is selected to provide sand control at a wellbore.

20. The method according to claim 1, wherein the exertive force together with the drawdown pressure is selected to inhibit, reduce or mitigate sand mobilization at a wellbore.

21. The method according to claim 1, comprising the steps of reviewing the selected exertive force and the drawdown pressure from time to time during a lifetime of the wellbore and selecting a revised exertive force and drawdown pressure based on a present, or expected, downhole environment at the wellbore, the present, or expected, downhole environment having been modified due to previous operations at the wellbore.

22. A method according to claim 1, comprising the step of applying a particular hydrostatic pressure at the wellbore, in addition to the exertive force and the drawdown pressure, to modify operations at the subterranean formation.

23. The method according to claim 1, wherein the selection of one or both of the exertive force and the drawdown pressure is provided using at least one processor.

24. The method according to claim 23, wherein the at least one processor is configured with dedicated apparatus, general purpose apparatus including a personal computer, or a handheld device including a multimedia device.

25. An apparatus configured to determine a combination of a drawdown pressure at a wellbore and an exertive force to apply at the wellbore that a provide a particular permeability of a near wellbore formation in the wellbore, and to apply both the exertive force together with the drawdown pressure of the determined combination, to modify operations at a subterranean formation, both the exertive force and the drawdown pressure being controllable and being selected based on a downhole environment at the wellbore; the apparatus comprising a base pipe and a fluid pressure-responsive valve arrangement, the valve arrangement including a closure member and a biasing member operably coupled to the closure member, the apparatus configured such that:

applying a first pressure through the base pipe, prior to applying the exertive force, to the fluid pressure-responsive valve arrangement provides fluid communication with an activation chamber arranged at the subterranean formation;

applying a second pressure, different than the first pressure, through the base pipe to the fluid pressure-responsive valve arrangement activates the activation chamber to apply the exertive force; and applying a third pressure through the base pipe, while applying the exertive force, the third pressure force lower than the second pressure to the fluid pressure-responsive valve arrangement thereby moves the closure member of the valve arrangement under the influence of the biasing mechanism to a position where the closure member both prohibits fluid communication between the base pipe and activation chamber and also establishes fluid communication from the subterranean formation to the base pipe through the valve arrangement;

wherein the valve assembly includes a body defining at least one first port in fluid communication with the activation chamber and at least one second port in fluid communication with an exterior of the base pipe, wherein the closure member includes a sleeve movable within the body by the biasing mechanism to cover the at least one first port to thereby prohibit fluid communication between the base pipe and activation chamber and additionally to uncover the at least one second port to thereby establish fluid communication from the subterranean formation to the base pipe through the valve arrangement.

26. The apparatus according to claim 25, configured to modify production from a reservoir and/or injection operations at the formation.

27. The apparatus according to claim 25, configured to measure, determine, or predict, a downhole environment to select the exertive force and the drawdown pressure.

28. Apparatus according to claim 25, wherein the apparatus comprises a sand filter including a weave.

* * * * *